US010596815B2

(12) United States Patent
Okushima et al.

(10) Patent No.: US 10,596,815 B2
(45) Date of Patent: Mar. 24, 2020

(54) LIQUID EJECTION HEAD AND INKJET PRINTING APPARATUS

(71) Applicant: CANON KABUSHIKI KAISHA, Tokyo (JP)

(72) Inventors: Shingo Okushima, Kawasaki (JP); Satoshi Oikawa, Yokohama (JP); Satoshi Kimura, Kawasaki (JP); Tatsurou Mori, Yokohama (JP); Kengo Umeda, Tokyo (JP); Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 15/942,891

(22) Filed: Apr. 2, 2018

(65) Prior Publication Data

US 2018/0304630 A1 Oct. 25, 2018

(30) Foreign Application Priority Data

Apr. 21, 2017 (JP) ..... 2017-084681
Mar. 2, 2018 (JP) ..... 2018-037486

(51) Int. Cl.
*B41J 2/14* (2006.01)
*B41J 2/155* (2006.01)

(52) U.S. Cl.
CPC ..... *B41J 2/14072* (2013.01); *B41J 2/14024* (2013.01); *B41J 2/155* (2013.01); *B41J 2002/14362* (2013.01); *B41J 2002/14491* (2013.01); *B41J 2202/12* (2013.01); *B41J 2202/19* (2013.01); *B41J 2202/20* (2013.01); *B41J 2202/21* (2013.01)

(58) Field of Classification Search
CPC ..... B41J 2/14072; B41J 2/155; B41J 2002/14362; B41J 2002/14491; B41J 2202/12; B41J 2202/20; B41J 2202/21
See application file for complete search history.

(56) References Cited

U.S. PATENT DOCUMENTS

| | | | | |
|---|---|---|---|---|
| 6,068,367 | A | 5/2000 | Fabbri | |
| 6,180,018 | B1 | 1/2001 | Miyagawa et al. | 216/27 |
| 6,302,504 | B1 | 10/2001 | Imanaka et al. | 347/9 |
| 6,315,853 | B1 | 11/2001 | Kubota et al. | 156/257 |
| 6,609,782 | B2 | 8/2003 | Mori | 347/50 |
| 6,629,755 | B2 | 10/2003 | Saito et al. | 347/58 |

(Continued)

FOREIGN PATENT DOCUMENTS

JP 07-186386 A 7/1995

OTHER PUBLICATIONS

U.S. Appl. No. 15/837,470, filed Dec. 11, 2017.

(Continued)

*Primary Examiner* — Alessandro V Amari
*Assistant Examiner* — Kendrick X Liu
(74) *Attorney, Agent, or Firm* — Venable LLP

(57) ABSTRACT

A liquid ejection head is capable of performing high-speed ejection operation as well as reducing a depth dimension. For this purpose, in a configuration in which flexible circuits electrically connect element substrates to electrical substrates, the electrical substrates are arrayed in two lines along a plane different from a plane on which the element substrates are arrayed and the flexible circuits electrically connect the element substrates to the electrical substrates while being bent.

20 Claims, 18 Drawing Sheets

(56) References Cited

U.S. PATENT DOCUMENTS

| | | | | |
|---|---|---|---|---|
| 6,945,622 | B2 | 9/2005 | Sakurai | 347/5 |
| 7,115,975 | B2 | 10/2006 | Mori | 257/668 |
| 7,354,125 | B2 | 4/2008 | Hirayama et al. | 347/12 |
| 7,758,142 | B2 | 7/2010 | Silverbrook | |
| 7,815,272 | B2 | 10/2010 | Kasai et al. | 347/12 |
| 7,896,474 | B2 | 3/2011 | Kasai et al. | 347/56 |
| 7,918,538 | B2 | 4/2011 | Sakurai | 347/57 |
| 8,052,251 | B2 | 11/2011 | Kudo et al. | 347/65 |
| 8,147,039 | B2 | 4/2012 | Kurokawa et al. | 347/56 |
| 8,523,325 | B2 | 9/2013 | Sakurai et al. | 347/50 |
| 8,529,003 | B2 | 9/2013 | Sakurai | 347/9 |
| 8,746,847 | B2 | 6/2014 | Kishikawa et al. | 347/50 |
| 8,757,771 | B2 | 6/2014 | Tsuchii et al. | 347/40 |
| 9,033,457 | B2 | 5/2015 | Oikawa et al. | 347/20 |
| 9,039,144 | B2 | 5/2015 | Umeda | 347/50 |
| 9,221,257 | B2 | 12/2015 | Moriya et al. | B41J 2/14145 |
| 9,221,258 | B2 | 12/2015 | Akama et al. | B41J 2/1433 |
| 9,238,361 | B2 | 1/2016 | Muraoka et al. | B41J 2/01 |
| 9,248,650 | B2 | 2/2016 | Muraoka et al. | B41J 2/1433 |
| 9,266,329 | B2 | 2/2016 | Kuroda et al. | B41J 2/1433 |
| 9,283,748 | B2 | 3/2016 | Umeda et al. | B41J 2/04563 |
| 9,365,043 | B2 | 6/2016 | Toda et al. | B41J 2/1752 |
| 9,370,928 | B2 | 6/2016 | Toda et al. | B41J 2/14072 |
| 9,375,920 | B2 | 6/2016 | Akama et al. | B41J 2/14072 |
| 9,446,592 | B2 | 9/2016 | Seki et al. | B41J 2/1433 |
| 9,457,566 | B2 | 10/2016 | Kuroda et al. | B41J 2/14024 |
| 9,475,288 | B2 | 10/2016 | Kudo et al. | B41J 2/14 |
| 9,592,668 | B2 | 3/2017 | Kuroda et al. | B41J 2/1433 |
| 9,597,870 | B2 | 3/2017 | Sakurai et al. | B41J 2/14072 |
| 9,616,664 | B2 | 4/2017 | Oikawa et al. | B41J 2/21 |
| 9,724,919 | B2 | 8/2017 | Hirayama et al. | B41J 2/04506 |
| 9,731,504 | B2 | 8/2017 | Sekine et al. | B41J 2/1408 |
| 9,751,310 | B2 | 9/2017 | Karita et al. | B41J 2/1623 |
| 9,962,937 | B2 | 5/2018 | Okushima et al. | B41J 2/155 |
| 2002/0060715 | A1* | 5/2002 | Karita | B41J 2/14016 347/42 |
| 2006/0044355 | A1* | 3/2006 | Ito | B41J 2/14209 347/59 |
| 2007/0008375 | A1* | 1/2007 | Tanikawa | B41J 2/14072 347/50 |
| 2008/0100668 | A1* | 5/2008 | Silverbrook | B41J 2/155 347/50 |
| 2017/0087833 | A1* | 3/2017 | Sugiura | B41J 2/14072 |
| 2017/0197439 | A1 | 7/2017 | Okushima et al. | B41J 2/185 |
| 2017/0232737 | A1 | 8/2017 | Komamiya et al. | 347/17 |
| 2017/0274647 | A1 | 9/2017 | Aoki et al. | B41J 2/0458 |
| 2017/0313076 | A1 | 11/2017 | Okushima et al. | B41J 2/155 |
| 2017/0326875 | A1 | 11/2017 | Nakakubo et al. | B41J 2/04535 |
| 2017/0341379 | A1 | 11/2017 | Umeda et al. | B41J 2/04548 |
| 2017/0341398 | A1 | 11/2017 | Tamenaga et al. | B41J 2/16505 |
| 2019/0047286 | A1* | 2/2019 | Matsuo | B41J 2/14 |

OTHER PUBLICATIONS

U.S. Appl. No. 15/992,667, filed May 30, 2018.
U.S. Appl. No. 15/976,470, filed May 10, 2018.
U.S. Appl. No. 15/936,664, filed Mar. 27, 2018.
U.S. Appl. No. 15/947,129, filed Apr. 6, 2018.

* cited by examiner

LIQUID EJECTION HEAD AND INKJET PRINTING APPARATUS

BACKGROUND OF THE INVENTION

Field of the Invention

The present invention relates to a liquid ejection head and an inkjet printing apparatus.

Description of the Related Art

In some liquid ejection heads for a full line type inkjet printing apparatus, printing element substrates are arrayed in a width direction of a print medium to elongate heads and improve manufacturing yields. For example, U.S. Pat. No. 7,758,142 discloses that power and an ejection signal are supplied to each of printing element substrates arrayed in a line from an electrical substrate. Japanese Patent Laid-Open No. H 07-186386 (1995) discloses that printing element substrates are arrayed in two lines and electrical substrates for supplying an ejection signal and power are laid out on both sides of the two lines.

In a case where the printing element substrates arrayed as disclosed in Japanese Patent Laid-Open No. H 07-186386 (1995) are electrically connected to two electrical substrates on both sides, a voltage drop can be suppressed when supplying power to the printing element substrates as compared with a case of arraying electrical substrates in a line as disclosed in U.S. Pat. No. 7,758,142. As a result, more ejection elements can be provided on each printing element substrate and an image of a higher density can be printed at higher speed.

In the configuration disclosed in Japanese Patent Laid-Open No. H 07-186386 (1995), however, electrical substrates are provided outside printing element substrates in a direction intersecting the array direction of the printing element substrates on a surface on which the printing element substrates are arrayed, which increases the depth dimension of the liquid ejection head.

SUMMARY OF THE INVENTION

The present invention has been accomplished in order to solve the problem described above. Thus, an object of the present invention is to provide a liquid ejection head capable of performing high-speed ejection operation as well as reducing a size in a depth dimension.

According to a first aspect of the present invention, there is provided a liquid ejection head comprising: a plurality of element substrates on which elements configured to eject liquid are arrayed; a plurality of electrical substrates each equipped with a first terminal and configured to supply power and an ejection signal to the element substrates; and a plurality of flexible circuits each equipped with a second terminal electrically connected to the first terminal and configured to connect the element substrate to the electrical substrate electrically, wherein the plurality of electrical substrates form a plurality of electrical substrate arrays along a plane different from a plane on which the plurality of element substrates are arrayed, and extending in a direction in which the element substrates are arrayed, each of the flexible circuits electrically connects the element substrate to the electrical substrate while being bent, the plurality of electrical substrate arrays include two electrical substrate arrays arranged such that at least parts of first surfaces of the electrical substrates are opposed to each other, and electrical connection portions between the first terminals and the second terminals are provided on second surfaces which are back surfaces of the first surfaces of the electrical substrates.

According to a second aspect of the present invention, there is provided an inkjet printing apparatus configured to print an image on a print medium by ejecting ink based on an ejection signal by the use of an inkjet printing head, the inkjet printing head comprising: a plurality of element substrates on which elements configured to eject ink are arrayed; a plurality of electrical substrates each equipped with a first terminal and configured to supply power and an ejection signal to the plurality of element substrates; and a plurality of flexible circuits each equipped with a second terminal electrically connected to the first terminal and configured to connect the element substrate to the electrical substrate electrically, wherein the plurality of electrical substrates form electrical substrate arrays along a plane different from a plane on which the plurality of element substrates are arrayed, and extending in a direction in which the plurality of element substrates are arrayed, each of the flexible circuits electrically connects the element substrate to the electrical substrate while being bent, the plurality of electrical substrate arrays include two electrical substrate arrays arranged such that at least parts of first surfaces of the electrical substrates are opposed to each other, and electrical connection portions between the first terminals and the second terminals are provided on second surfaces which are back surfaces of the first surfaces of the electrical substrates.

Further features of the present invention will become apparent from the following description of exemplary embodiments with reference to the attached drawings.

DESCRIPTION OF THE EMBODIMENTS

Figure 1:
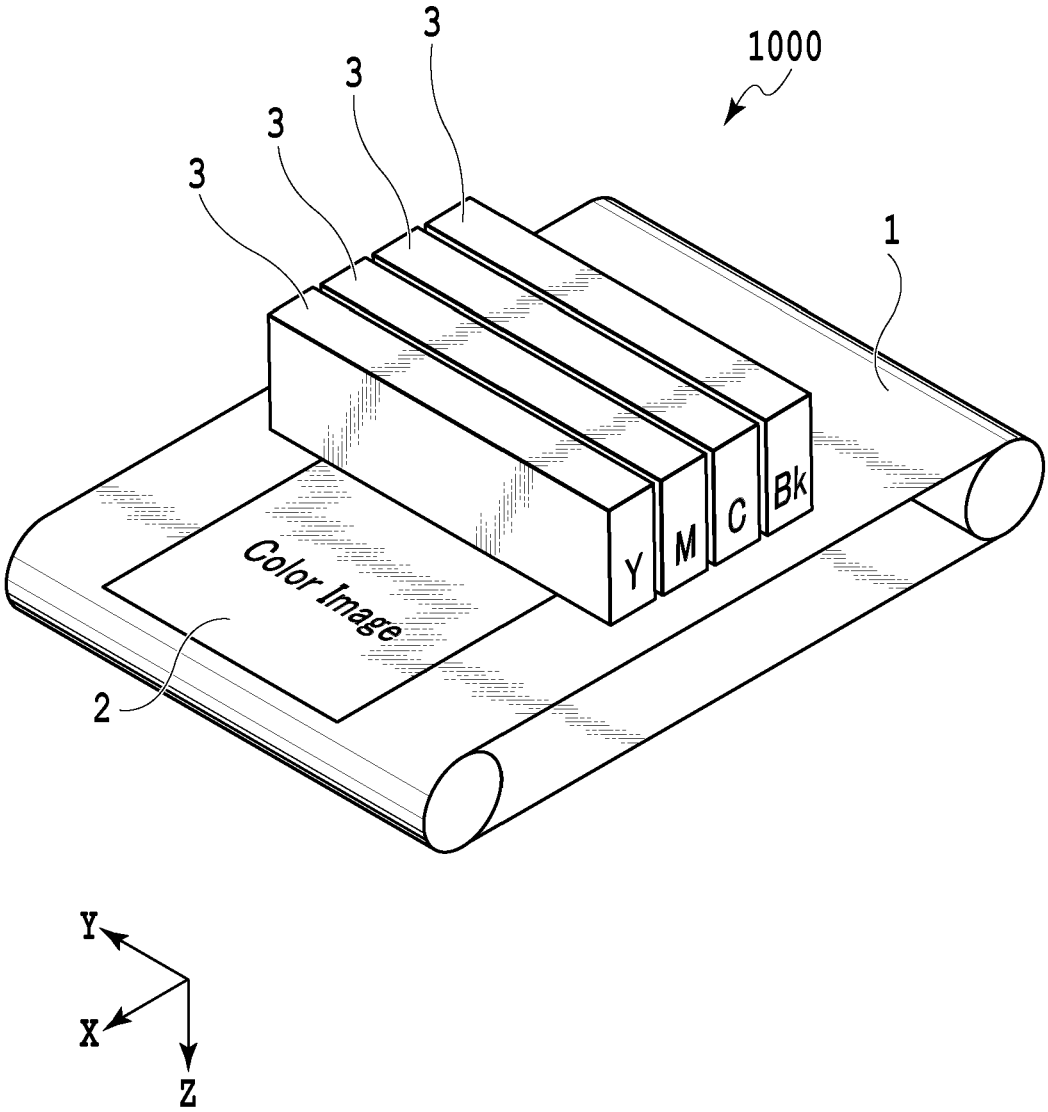
FIG. 1 is a diagram showing an example of use of liquid ejection heads.

FIG. 1 is a diagram showing an example of use of liquid ejection heads 3 of the present invention as inkjet printing heads. An inkjet printing apparatus 1000 is a full line type color inkjet printing apparatus, in which four liquid ejection heads 3 for ejecting cyan (C), magenta (M), yellow (Y), and black (K) ink are arrayed in an X direction. Ejection ports are arrayed in a Y direction in each liquid ejection head 3. The ejection ports eject ink in a Z direction to a print medium 2 conveyed by a conveying unit 1 in the X direction at a constant speed, thereby printing a desired image on the print medium 2.

Figure 2:
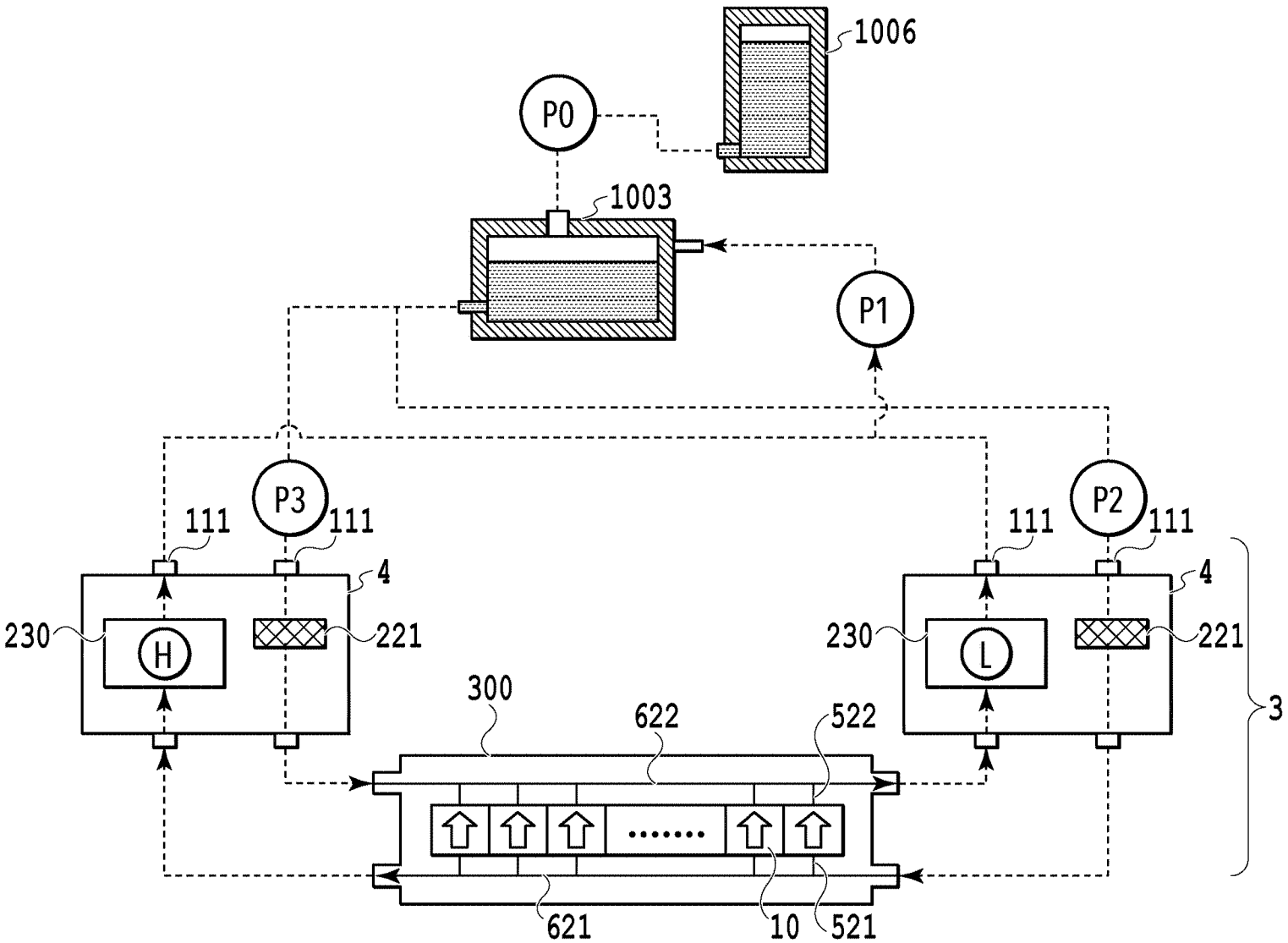
FIG. 2 is a diagram showing an ink circulation flow path with respect to a liquid ejection head.

FIG. 2 is a diagram showing a circulation flow path for supplying ink to and collecting ink from the liquid ejection head 3. Although FIG. 2 shows a circulation flow path for one ink color, such a circulation flow path is prepared for each of CMYK ink colors in the printing apparatus 1000. A buffer tank 1003 is connected to circulation pumps P1 to P3 whereby ink is circulated in the circulation path including the liquid ejection head 3. If the amount of ink remaining in the buffer tank 1003 decreases, a refilling pump P0 is activated to refill the buffer tank 1003 with ink from a large-capacity main tank 1006 fixed in the apparatus. The buffer tank 1003 has an atmosphere communication port to discharge incoming bubbles from the liquid circulation flow path.

The circulation pump P1 guides ink that is flowed out from liquid supply units 4 through liquid connection portions 111 to the buffer tank 1003. Providing the circulation pump P1 can reduce the influence of a pressure head of the buffer tank 1003 on the liquid ejection head 3, with the result that the buffer tank 1003 can be laid out with a high degree of freedom in the inkjet printing apparatus 1000. It should be noted that the above advantageous result can be achieved if the circulation pump P1 is replaced with, for example, a water head tank disposed to have a predetermined water head difference with respect to negative pressure control units 230. The circulation pumps P2 and P3 supply ink stored in the buffer tank 1003 to the liquid supply units 4 through the liquid connection portions 111.

The liquid supply units 4 pass ink supplied from the liquid connection portions 111 through filters 221 to remove foreign matter and then supply the ink to a liquid ejection unit 300. On the other hand, ink collected from the liquid ejection unit 300 flows into the negative pressure control units 230 of the liquid supply units 4.

The negative pressure control units 230 include a negative pressure control unit H that causes ink to flow out at high fluid pressure and a negative pressure control unit L that causes ink to flow out at low fluid pressure. The negative pressure control units H and L are connected to a common supply flow path 621 and a common collection flow path 622 in the liquid ejection unit 300 located upstream of the negative pressure control units, respectively. The negative pressure control units 230 function as so-called back pressure regulators to regulate the fluid pressure in the common supply flow path 621 and the common collection flow path 622 within a certain range regardless of ink consumption by ejection operation of the liquid ejection unit 300.

Besides the common supply flow path 621 through which ink flows at high pressure from the negative pressure control unit H and the common collection flow path 622 through which ink flows at low pressure from the negative pressure control unit L, the liquid ejection unit 300 is equipped with printing element substrates 10 which are arrayed in the Y direction and each of which comprises printing elements. Each printing element substrate 10 is connected to an individual supply flow path 521 connected to the common supply flow path 621 and an individual collection flow path 522 connected to the common collection flow path 622. An ink flow is produced by a difference in fluid pressure between the common supply flow path 621 and the common collection flow path 622. More specifically, ink flows into the printing element substrate 10 from the common supply flow path 621 having high pressure through the individual supply flow paths 521 and the ink then flows out from the printing element substrate 10 to the common collection flow path 622 through the individual collection flow paths 522. When each printing element substrate 10 performs ejection operation, circulating ink is partly consumed by the ejection and the rest of the ink is discharged into the liquid supply units 4 through the individual collection flow paths 522 and the common collection flow path 622.

In the liquid ejection head 3 using the circulation supply circuit described above, heat generated in ejection operation is dissipated by circulating liquid, which reduces the possibility of an ejection failure due to heat accumulation. Further, since thickened ink and foreign matter are less prone to stay, the ejection state of all nozzles can be stable. Furthermore, in a configuration of providing the negative pressure control unit H and the negative pressure control unit L at respective ends of the liquid ejection head 3 like the present embodiment, the flow direction in the common supply flow path 621 (right to left) and the flow direction in the common collection flow path 622 (left to right), which are parallel to each other with the printing element substrates 10 interposed therebetween, are opposed to each other. Accordingly, heat exchange is promoted between the common supply flow path 621 and the common collection flow path 622 through each printing element substrate 10, thereby equalizing the temperatures of the printing element substrates 10. As a result, variations in the amount of ejection due to a temperature difference are suppressed and density unevenness is reduced.

Figure 3A:
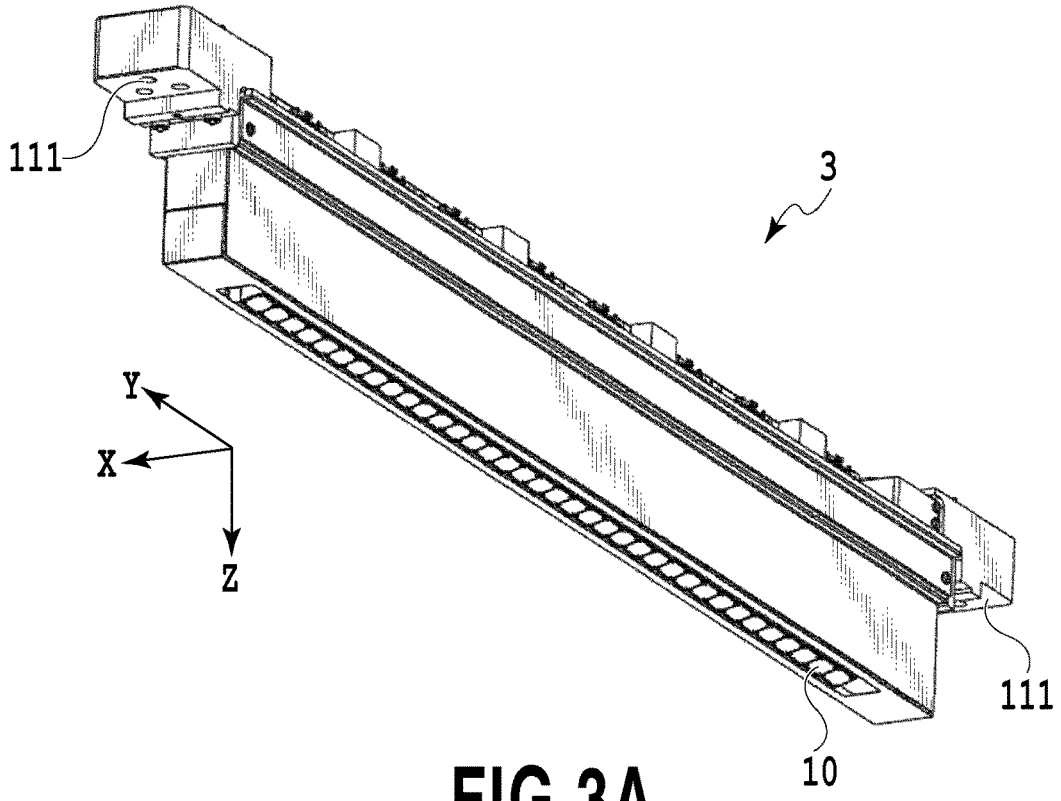
FIGS. 3A and 3B are perspective views of the appearance of the liquid ejection head.
Figure 3B:
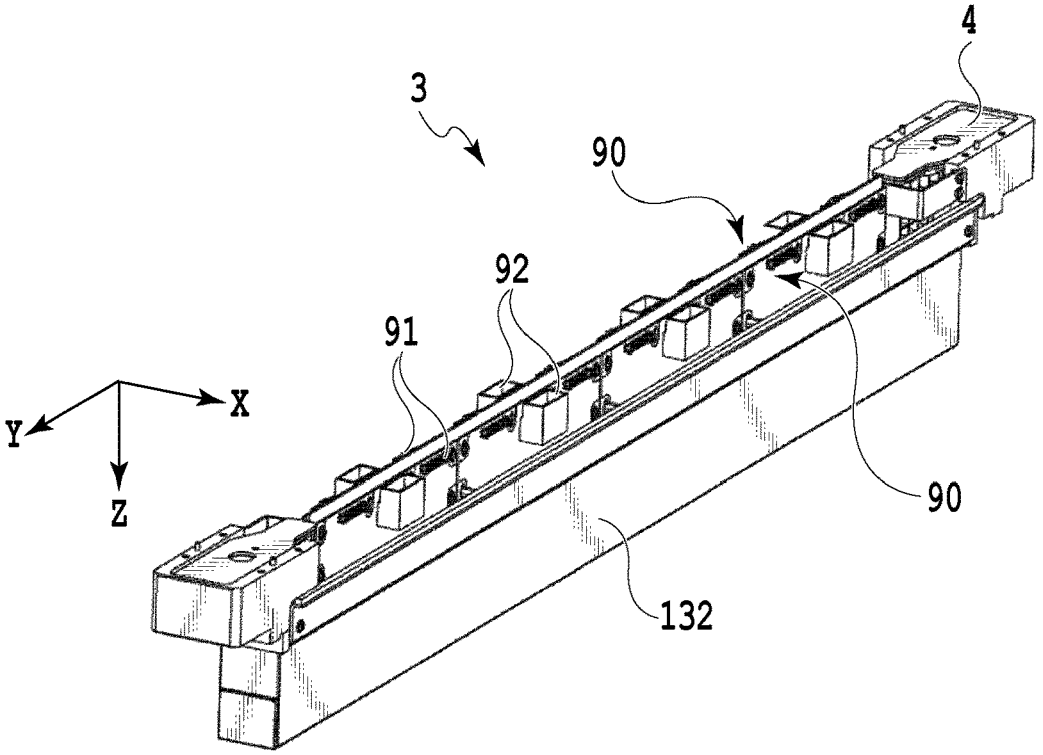

FIGS. 3A and 3B are perspective views of the appearance of the liquid ejection head 3. The liquid ejection head 3 of the present embodiment is a full line type color inkjet printing head that covers the entire width of the print medium 2. A number of printing element substrates 10 are arrayed in the Y direction and each printing element substrate 10 ejects ink of a predetermined color in the Z direction based on ejection data. Ink circulating in the printing element substrates 10 is supplied or discharged through the liquid supply units 4 provided at respective ends in the Y direction. Each liquid connection portion 111 is connected to a tube communicating with the circulation pump P1, P2, or P3.

On the other hand, ejection data and power for ejection operation are input to signal input terminals 91 and power supply terminals 92, respectively, on electrical substrates 90, on which electrical wirings are laid out for various purposes, and supplied to the printing element substrates 10 via flexible circuits 40 (not shown in FIGS. 3A and 3B). In the present embodiment, the signal input terminals 91 and the power supply terminals 92 are symmetrically provided on the electrical substrates 90 on both sides in the X direction.

The flexible circuits 40 (not shown in FIGS. 3A and 3B) connect the electrical substrates 90 on both sides to respective ends of the printing element substrates 10. Shields 132 protect such electrical connection of the electrical substrates 90 from both sides in the X direction.

Figure 4:
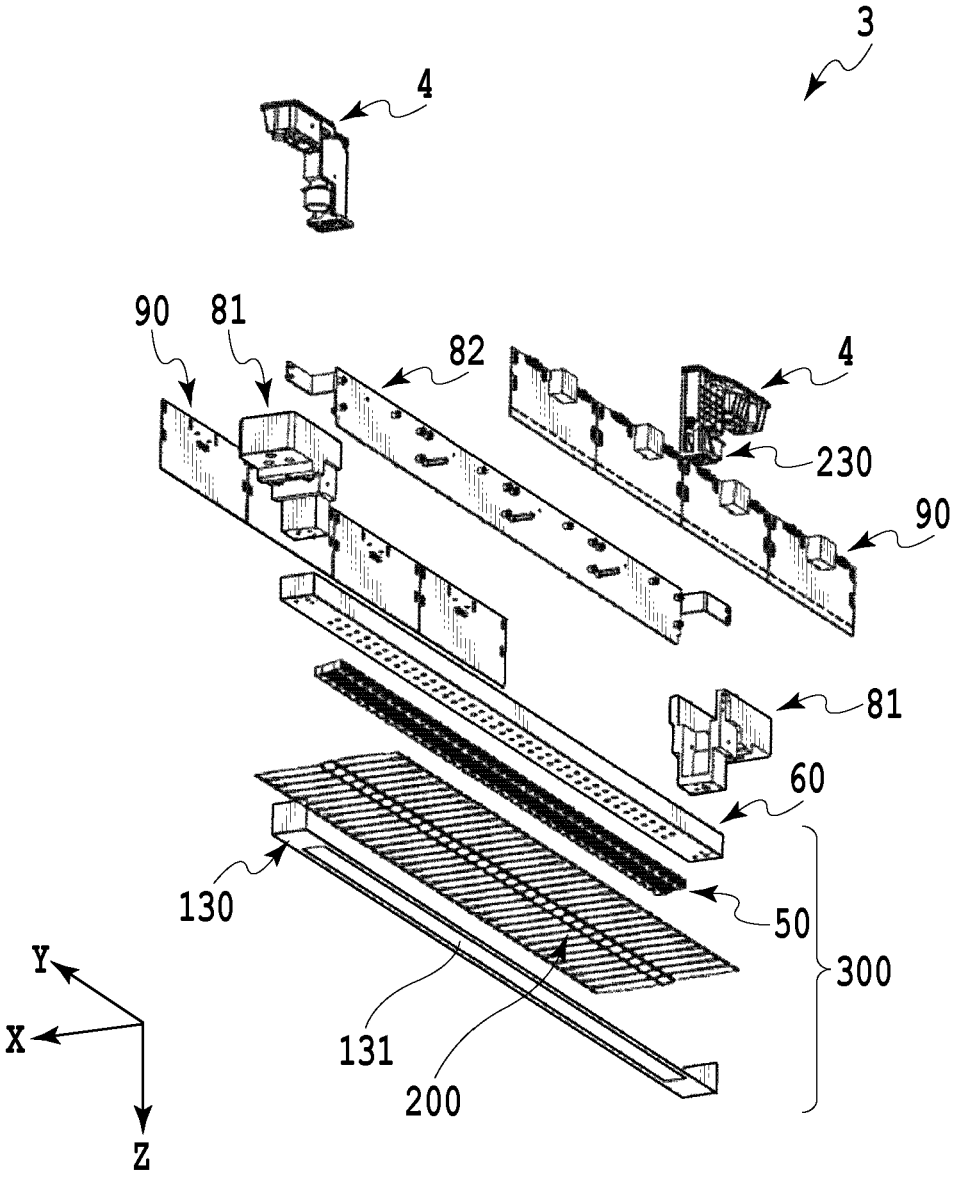
FIG. 4 is an exploded perspective view of the liquid ejection head.

FIG. 4 is an exploded perspective view of the liquid ejection head 3. An electrical substrate support 82 extends in the Y direction and electrical substrates 90 are attached to both surfaces of the electrical substrate support 82 on the +X and −X sides such that the electrical substrates 90 are located continuously in the Y direction. On the +Z side of these members, a second flow path member 60, first flow path members 50, ejection modules 200, and a cover member 130 are layered in this order so as to form the liquid ejection unit 300. The stiffness of the liquid ejection head 3 as a whole is ensured mainly by the second flow path member 60. The cover member 130 has an opening 131 to expose ejection port surfaces of the printing element substrates 10 arrayed as parts of the ejection modules 200. Two liquid ejection unit supports 81 are attached from the +Y and −Y sides of the liquid ejection unit 300 and fastened to the electrical substrate support 82 with screws. A liquid supply unit 4 comprising the negative pressure control unit H for high pressure and a liquid supply unit 4 comprising the negative pressure control unit L for low pressure are attached to the liquid ejection unit supports 81 from the −Z side, respectively, thereby connecting the liquid supply units 4 fluidly to the second flow path member 60.

Figure 5A:
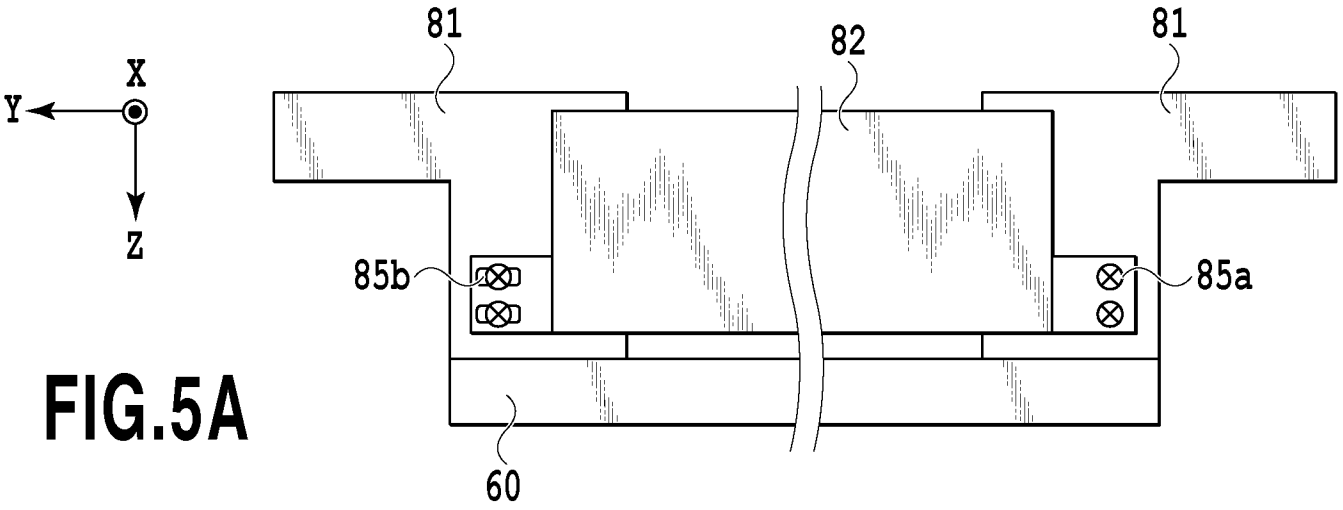
FIGS. 5A and 5B are diagrams showing a state of connection of an electrical substrate support.
Figure 5B:
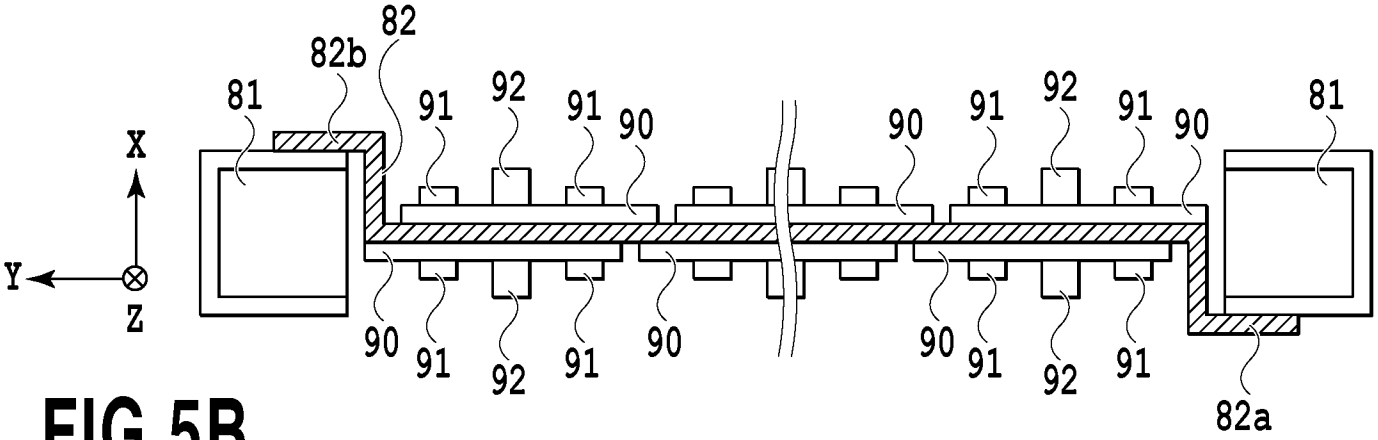

FIGS. 5A and 5B are diagrams showing a state of connection between the liquid ejection unit supports 81 and the electrical substrate support 82. FIG. 5A is a cross-sectional view from the X side and FIG. 5B is a top view from the −Z side.

One end of the electrical substrate support 82 is an electrical substrate fixing portion 82*a* protruding in the X direction and the other end is an electrical substrate fixing portion 82*b* protruding in the −X direction. The liquid ejection unit support 81 is fastened to the side surface of each fixing portion with screws through screw holes 85*a* provided in the electrical substrate fixing portion 82*a* or screw holes 85*b* provided in the electrical substrate fixing portion 82*b*. Since the two liquid ejection unit supports 81 are fixed to the electrical substrate support 82 symmetrically with respect to a point, the stiffness of the electrical substrate support 82 is improved and the liquid ejection head is prevented from being deformed.

At this time, the screw holes 85*b* in the electrical substrate fixing portion 82*b* are movable holes elongated in the Y direction, and maintain a state of connection between the electrical substrate support 82 and the second flow path member 60 even in the case of displacement caused by a difference in coefficient of linear expansion between them. Further, when liquid ejection heads 3 are arranged in parallel as shown in FIG. 1, displacement of a printed position of each color can be prevented by providing movable holes on the same side of the liquid ejection heads in the Y direction. It is only necessary to elongate such movable holes in the Y direction. This is because displacement between materials caused by a difference in coefficient of linear expansion generally tends to occur in a direction in which an extension distance is long. If a movable area is secured in the X direction or Z direction, in which the extension distance is short, the electrical substrate 90 is allowed to vibrate in various directions.

Although the drawings show a method of elongating the screw holes of the liquid ejection unit support 81*b* as an example to expand a movable area, elongated screw holes may be provided in the liquid ejection unit support 81*a* or in both of the liquid ejection unit supports 81*a* and 81*b*. Further, the electrical substrate support 82 and the liquid ejection unit supports 81*a* and 81*b* may be fastened by shoulder screws or by connections other than screws.

Figure 6A:
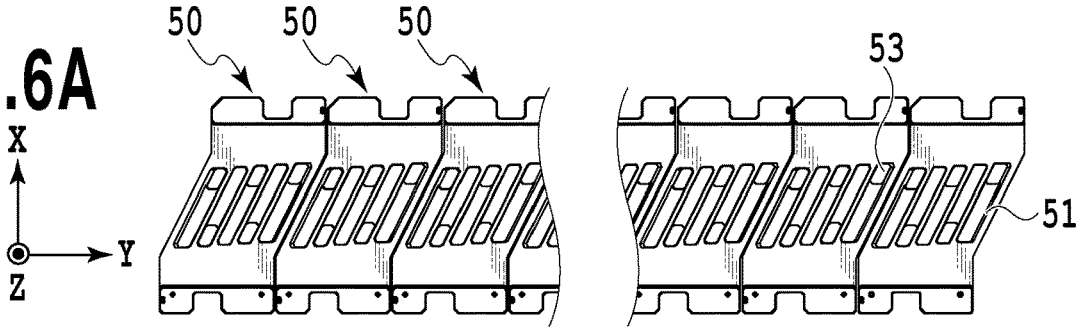
FIGS. 6A to 6E are diagrams showing connection between first flow path members and a second flow path member.
Figure 6B:
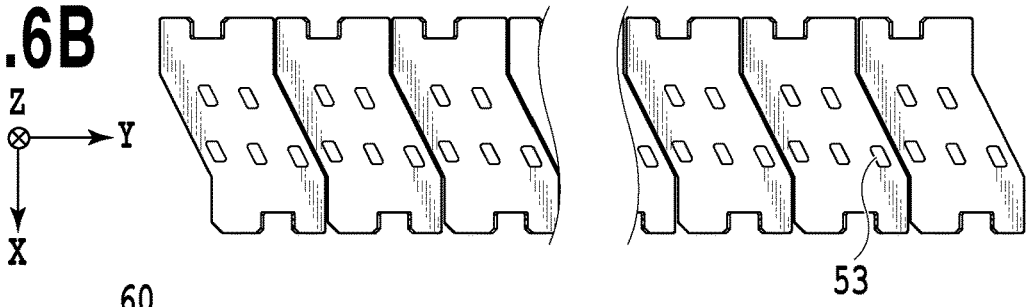
Figure 6C:
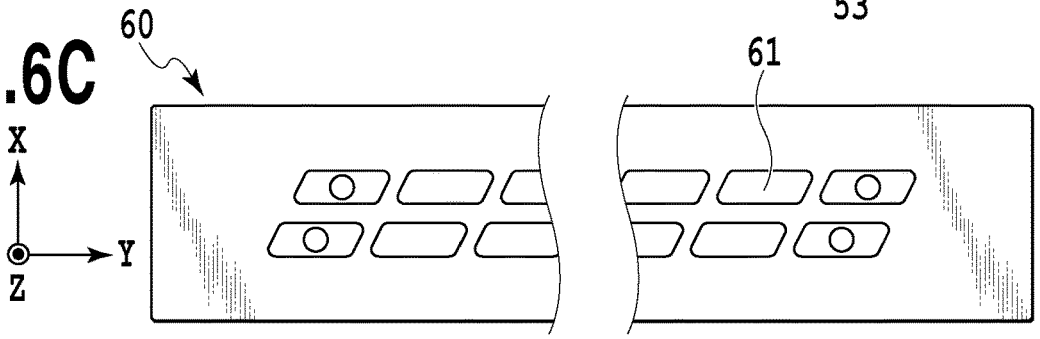
Figure 6D:
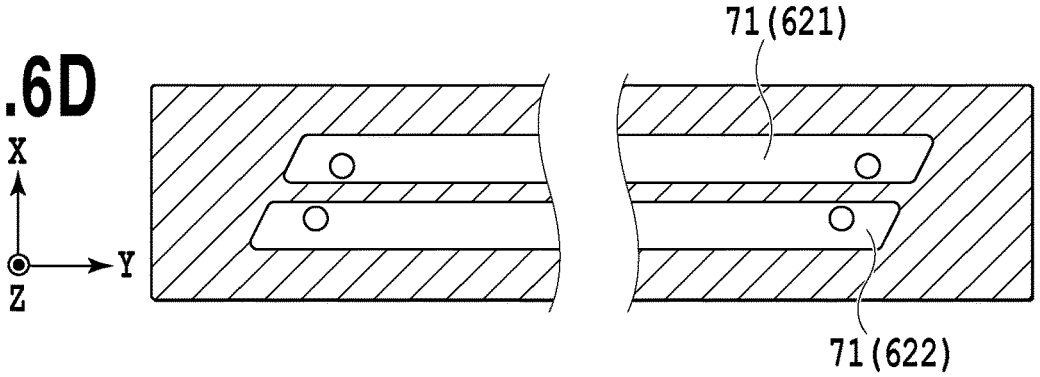
Figure 6E:
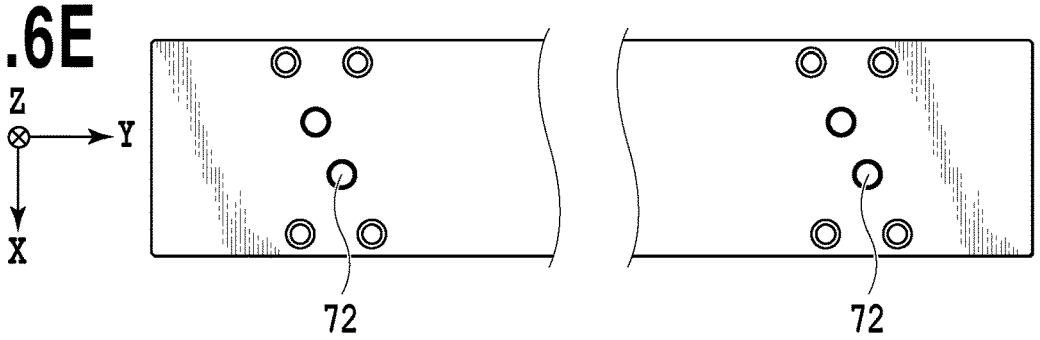

FIGS. 6A to 6E are diagrams showing a detailed configuration of connection between the first flow path members 50 and the second flow path member 60. FIGS. 6A and 6B show the front and back surfaces of the first flow path members 50. FIGS. 6C to 6E show the front surface, cross section, and back surface of the second flow path member 60. FIG. 6A shows surfaces to be in contact with the printing element substrates 10 of the ejection modules 200. FIG. 6E shows a surface to be in contact with the liquid supply units 4. The surfaces of the first flow path members 50 shown in FIG. 6B are brought into contact with the surface of the second flow path member 60 shown in FIG. 6C. These flow path members realize a flow path configuration for guiding ink supplied from the liquid supply units 4 to the printing element substrate 10 of each ejection module 200 and a flow path configuration for returning ink not consumed in each printing element substrate 10 to the liquid supply units 4.

The stiffness of the liquid ejection head 3 as a whole is ensured mainly by the second flow path member 60 having the shape of a flat plate. Accordingly, the material for the second flow path member 60 should preferably have sufficient resistance to corrosion by liquid and high mechanical strength. For example, it is preferable to use SUS, Ti, and alumina. On the other hand, the first flow path members 50 are formed by arraying flat plates, which are smaller than the second flow path member 60 and correspond to the ejection modules 200, that is, the printing element substrates 10, in the Y direction to have a length corresponding to the length of the second flow path member 60.

The surface of the second flow path member 60 (FIG. 6E) to be in contact with the liquid supply units 4 has communication ports 72 formed in positions connecting with the liquid connection portions 111 of the liquid supply units 4 shown in FIG. 2. The communication ports 72 communicate with common flow path grooves 71 formed in an interlayer and extending in the Y direction. One of the two common flow path grooves 71 corresponds to the common supply flow path 621 and the other corresponds to the common collection flow path 622. The surface of the second flow path member 60 (FIG. 6C) to be in contact with the surfaces of the first flow path members 50 shown in FIG. 6B has communication ports 61 formed along the two common flow path grooves 71 in positions corresponding to the printing element substrates 10.

The surface of each first flow path member 50 (FIG. 6B) to be in contact with the surface of the second flow path member 60 shown in FIG. 6C has individual communication ports 53 formed in positions corresponding to the communication ports 61 formed in the second flow path member 60. The individual communication ports 53 are connected to individual flow paths 51 for guiding ink to a position in which a nozzle array is formed on the surfaces (FIG. 6A) to be in contact with the printing element substrates 10 of the ejection modules 200.

Figure 7:
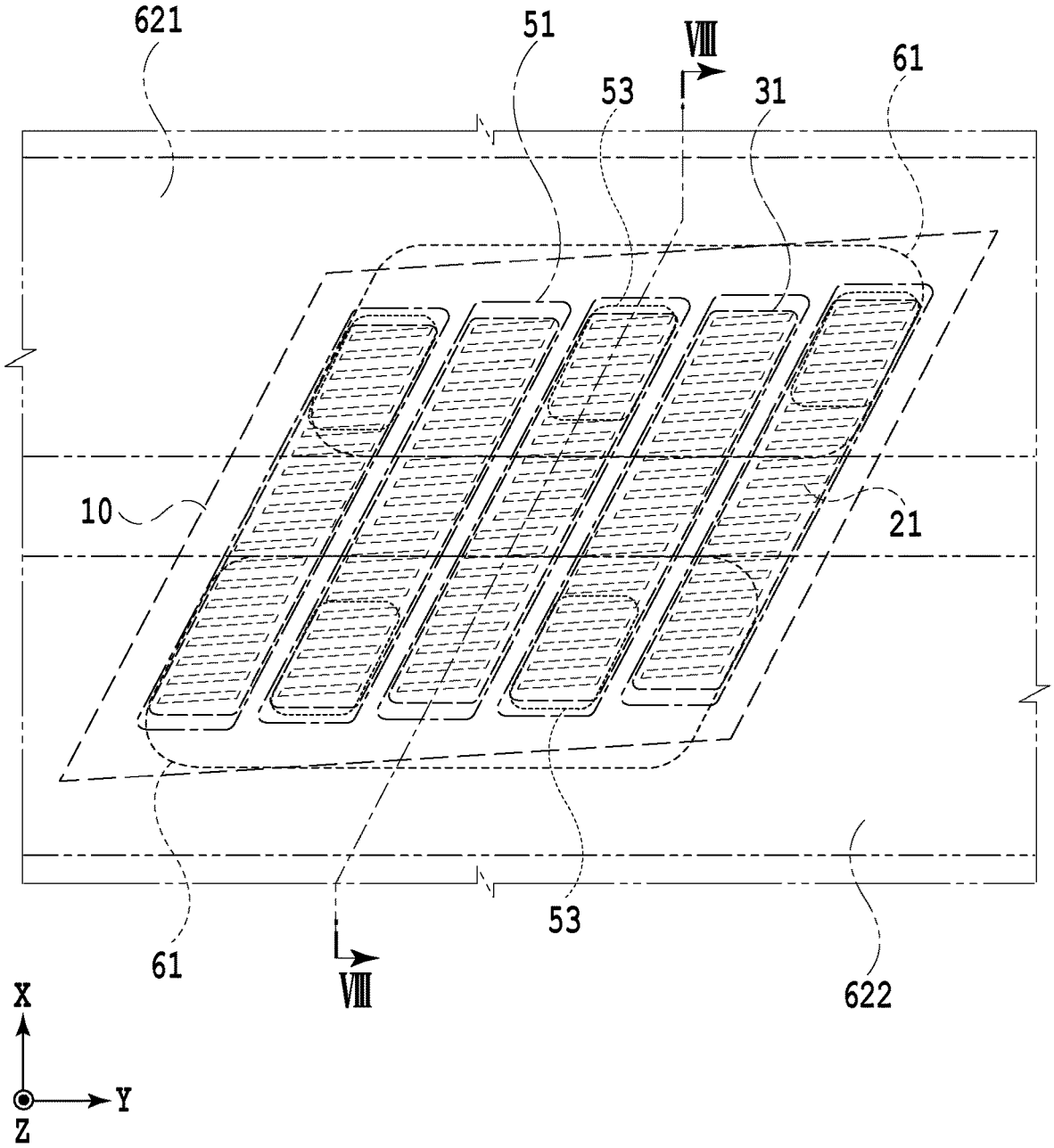
FIG. 7 is a perspective view showing the first flow path member and the second flow path member from a Z direction.
Figure 8:
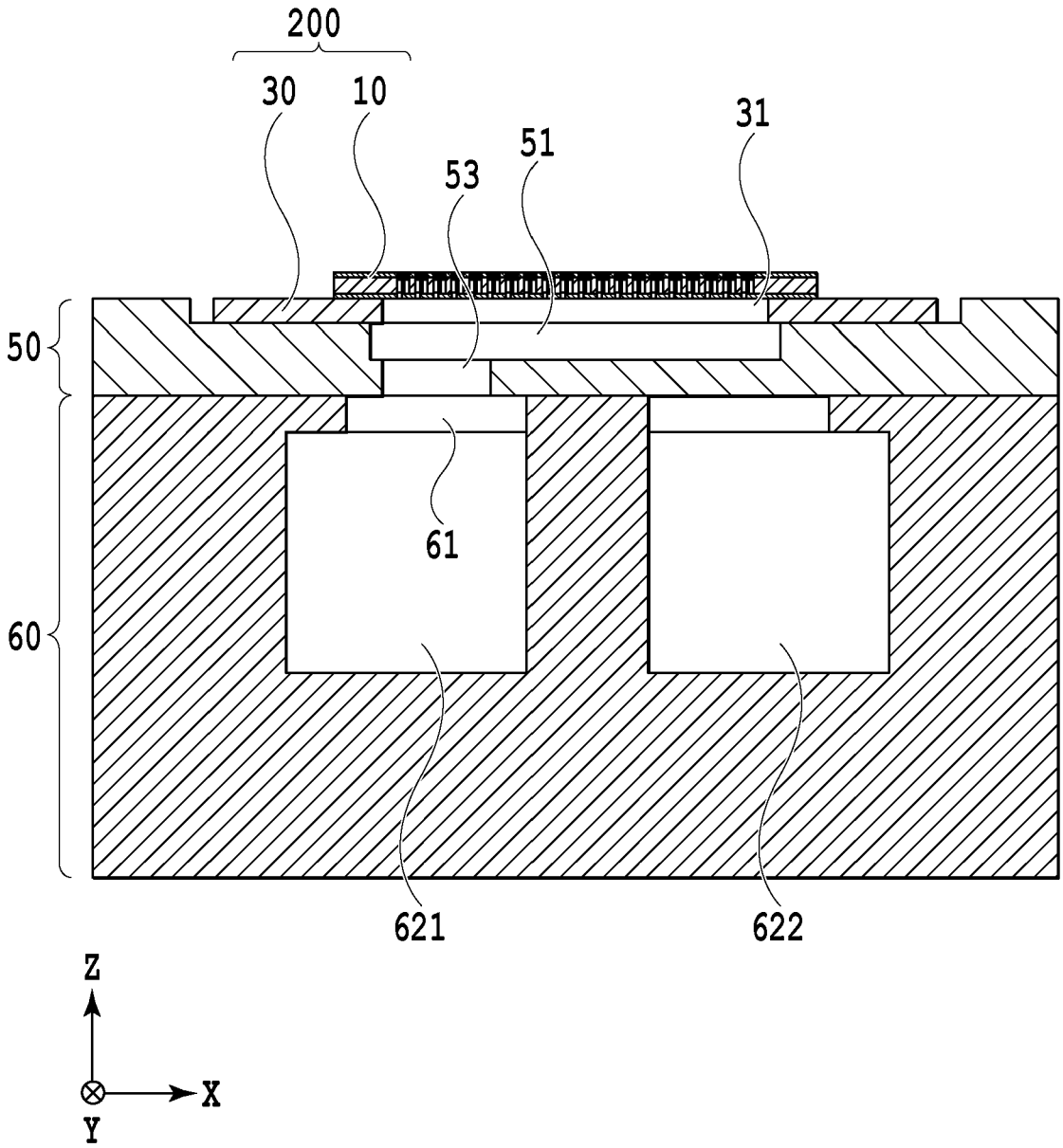
FIG. 8 is a cross-sectional view of flow paths of the liquid ejection head.

FIG. 7 is a perspective view of the first flow path member 50 and the second flow path member 60 from the Z side. FIG. 7 only shows an area corresponding to one of the first flow path members 50 (one of the printing element substrates). FIG. 8 shows a VIII-VIII cross section in FIG. 7 with a printing element substrate 10. The printing element substrate 10 is attached to the first flow path member 50 while adhering to a support member 30 having an opening.

The opening in the support member 30 between the printing element substrate 10 and the first flow path member 50 becomes a liquid supply port 31.

Ink moving in the common supply flow path 621 of the second flow path member 60 in the Y direction flows into the individual communication port 53 of the first flow path member 50 through the communication port 61 and then moves in the X direction in the individual flow path 51. Then, the ink is supplied to the printing element substrate 10 through the liquid supply port 31. Ink not consumed in the printing element substrate 10 is collected into the common collection flow path 622 of the second flow path member 60 through a liquid supply port 31, individual flow path 51, individual communication port 53, and communication port 61, which are different from those described above. Such an ink path for collection can be recognized in another cross section in FIG. 7. As described with reference to FIG. 2, the common supply flow path 621 is connected to the negative pressure control unit H for high flow pressure and the common collection flow path 622 is connected to the negative pressure control unit L for low flow pressure. As a consequence, in the liquid supply port 31 shown in FIG. 8, a stable ink flow from left to right in the drawing is produced irrespective of ejection frequency in the printing element substrate 10.

Figure 9A:
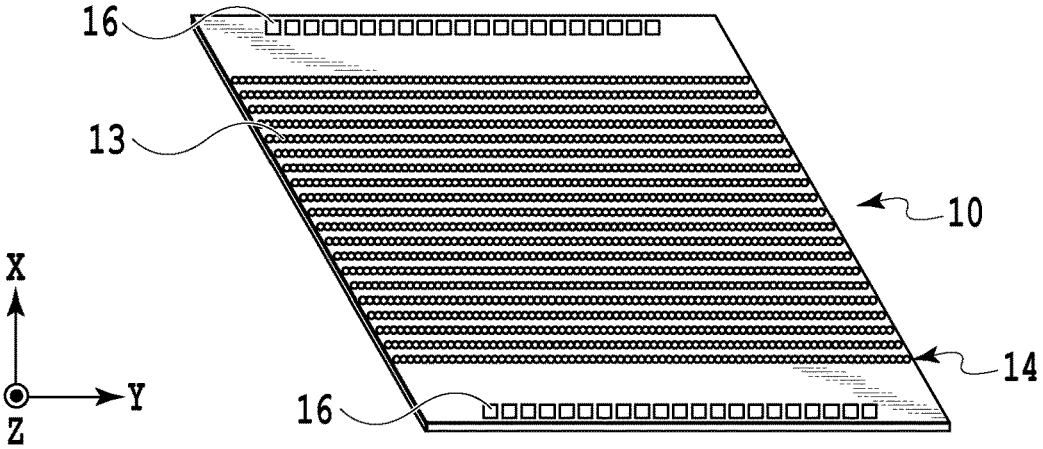
FIGS. 9A to 9C are diagrams showing a layer structure of a printing element substrate.
Figure 9B:
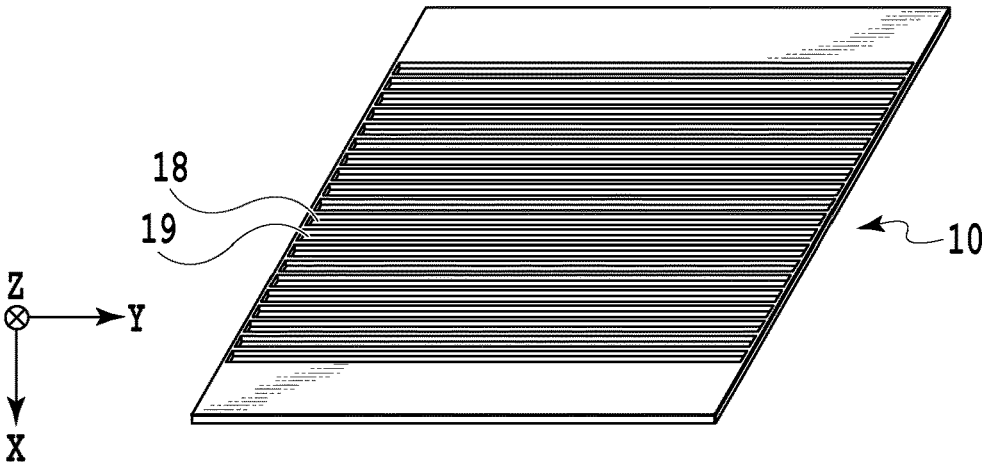
Figure 9C:
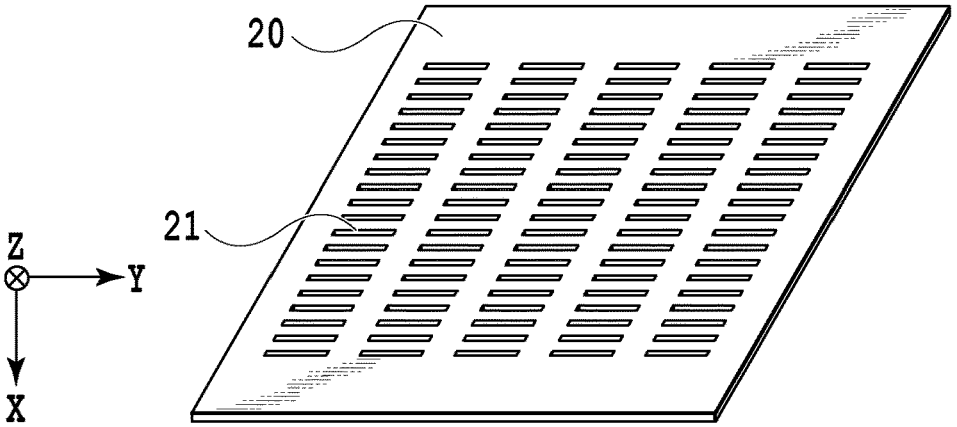

FIGS. 9A to 9C are diagrams showing a layer structure of the printing element substrate 10. FIG. 9A is a diagram showing the printing element substrate 10 from the ejection port surface side (the +Z side). FIG. 9B is a diagram showing the internal structure. FIG. 9C is a diagram showing the printing element substrate 10 from the back side (the −Z side). As shown in the drawings, the printing element substrate 10 of the present embodiment has the shape of a parallelogram and has a structure symmetric with respect to the center.

As shown in FIG. 9A, the printing element substrate 10 has 20 ejection port arrays 14 each of which includes ejection ports 13 arrayed in the Y direction and which are arranged in parallel in the X direction. Inside the printing element substrate 10, 20 liquid supply paths 18 and 20 liquid collection paths 19 corresponding to the respective ejection port arrays 14 are alternately arranged in parallel in the X direction as shown in FIG. 9B. The back surface of the printing element substrate 10 is equipped with a cover plate 20 in which openings 21 connecting with the liquid supply paths 18 and liquid collection paths 19 are formed in corresponding positions as shown in FIG. 9C.

Figure 10:
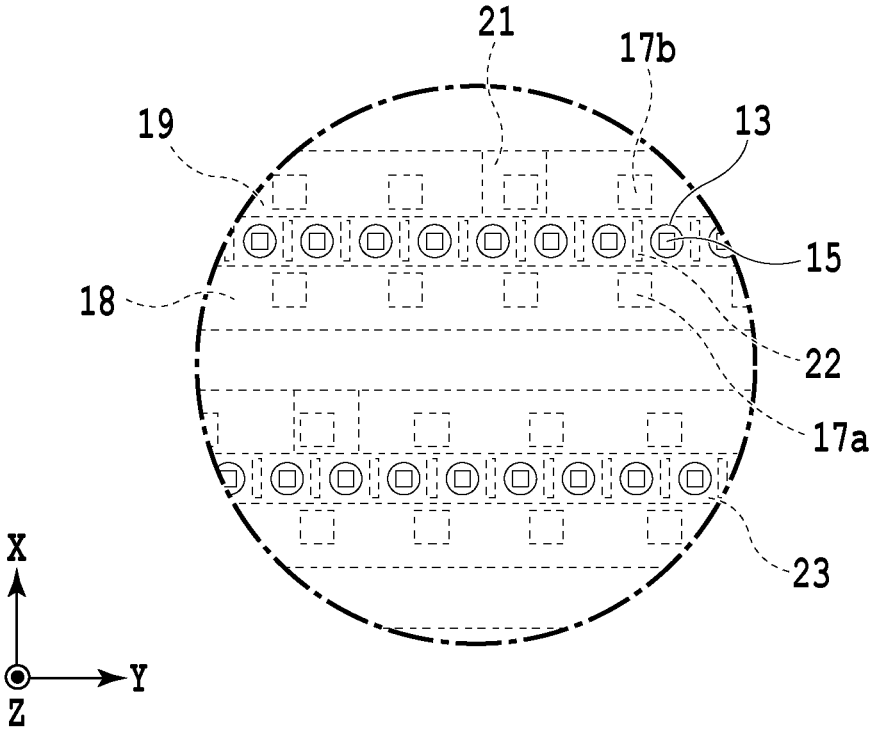
FIG. 10 is an enlarged plan view of the printing element substrate without a cover plate.

FIG. 10 is an enlarged plan view of the printing element substrate 10 without the cover plate 20. In the liquid ejection head 3 of the present embodiment, one printing element (nozzle) includes an energy generating element 15, a pressure chamber 23, and an ejection port 13. The pressure chamber 23 is defined by two partitions 22 arranged in the Y direction. One pressure chamber is equipped with one energy generating element. The energy generating element 15 is electrically connected to a terminal 16 shown in FIG. 9A and is subjected to drive control via the electrical substrate 90 and the flexible circuit 40. In this configuration, when a voltage pulse is applied to the energy generating element 15 based on ejection data, film boiling occurs in ink supplied to the pressure chamber 23 and the growth energy of bubbles causes ink to be ejected from the ejection port 13 in the position opposed to the energy generating element 15.

On respective sides of the ejection port array in the X direction, the liquid supply path 18 connected to the common supply flow path 621 to supply ink to the pressure chamber 23 and the liquid collection path 19 connected to the common collection flow path 622 to collect ink from the pressure chamber 23 extend in the Y direction. Supply ports 17*a* and collection ports 17*b* communicating with the pressure chambers 23 are formed in the liquid supply path 18 and the liquid collection path 19, respectively. Ink stored in the pressure chambers 23 is circulated between the pressure chambers 23 and the outside.

In the configuration described above, ink flows in the printing element substrate 10 in the order of the openings 21, liquid supply paths 18, supply ports 17*a*, pressure chambers 23, collection ports 17*b*, liquid collection paths 19, and openings 21. In a case where the energy generating element 15 is driven while ink flows through the pressure chambers 23, the ink is partly ejected from the ejection port 13. Ink stably flows through the pressure chambers 23 regardless of ejection frequency. Therefore, even if thickened ink, bubbles, foreign matter, and the like are mixed with the ink, they are guided (discharged) to the liquid collection paths 19 without staying in a particular position.

Figure 11:
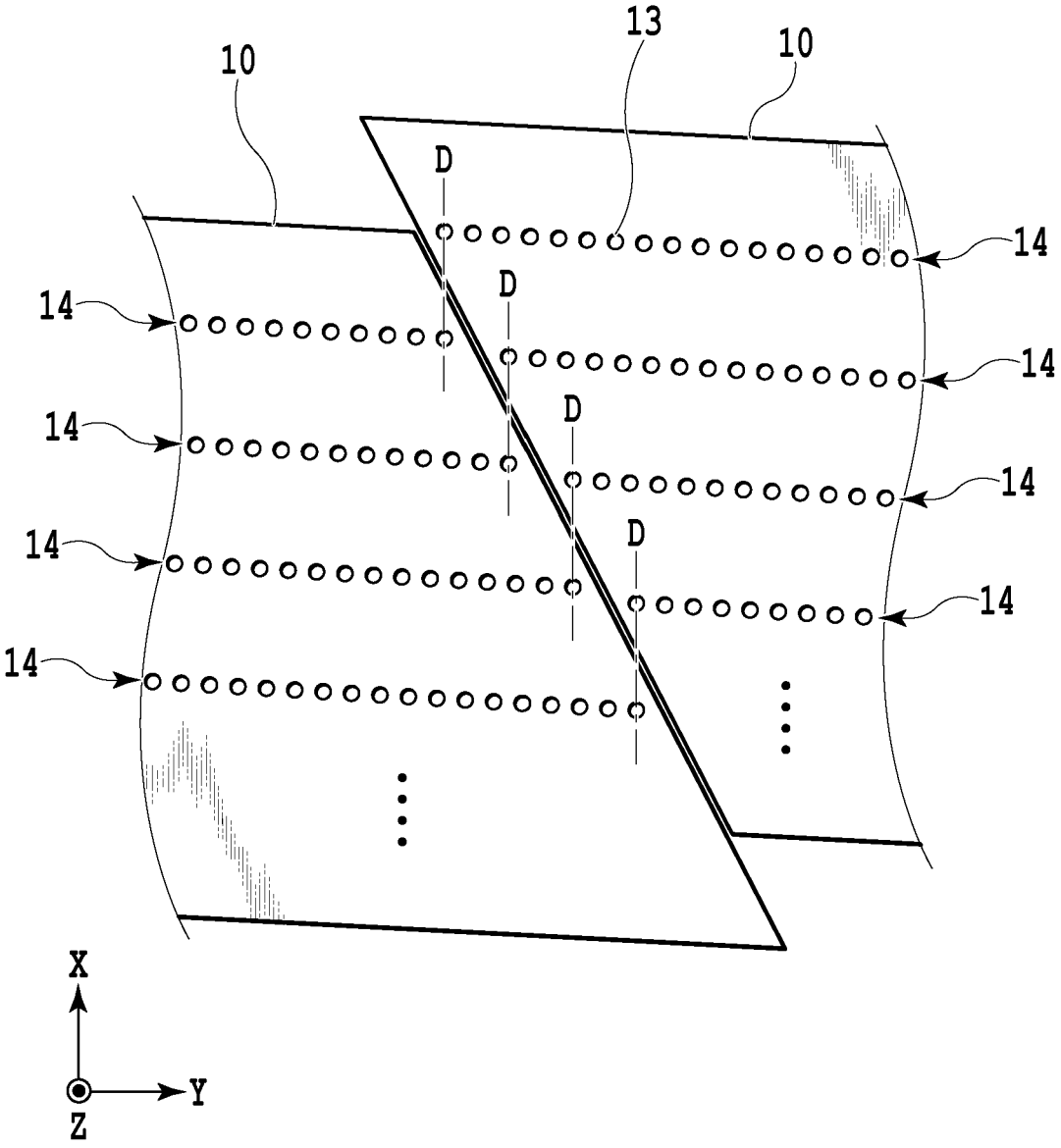
FIG. 11 is a diagram showing a state of connection between adjacent printing element substrates.

FIG. 11 is a diagram showing a state of connection between adjacent printing element substrates 10. As described with reference to FIG. 9A, the printing element substrate 10 of the present embodiment has the shape of a parallelogram and is equipped with 20 ejection port arrays each having a short length and extending in the Y direction. Such printing element substrates 10 are arranged with their sides in contact with each other such that the ejection ports 13 are located continuously in the Y direction, thereby forming 20 ejection port arrays 14.

In the liquid ejection head of the present embodiment, 20 nozzles included in different nozzle arrays can sequentially print dots of the same pixel line on a print medium conveyed in the X direction. That is, the frequency of printing of dots can be increased by 20 times as compared with a liquid ejection head having only one nozzle array. Further, even if an ejection failure occurs in any of the 20 nozzles which print the same pixel line, the other nozzles can perform ejection operation to compensate for the failure.

As shown in FIG. 11, in a connection portion between two printing element substrates 10, ejection ports 13 at the end of one printing element substrate 10 are laid out in the same pixel positions in the Y direction as those of ejection ports 13 at the end of the other printing element substrate 10. That is, the liquid ejection head 3 extending in the Y direction includes an area in which different printing element substrates overlap in the Y direction. The angles of the parallelogram are designed to enable this layout. In FIG. 11, two ejection ports 13 in each D line are laid out in the same position in the Y direction.

In the configuration described above, even if two printing element substrates 10 are somewhat misaligned and connected when manufacturing a liquid ejection head, an image in a position corresponding to the connection portion can be printed by cooperation between ejection ports included in the overlapping area. Therefore, a black stripe or white patch caused by the misalignment can be inconspicuous in an image printed on paper.

Figure 12:
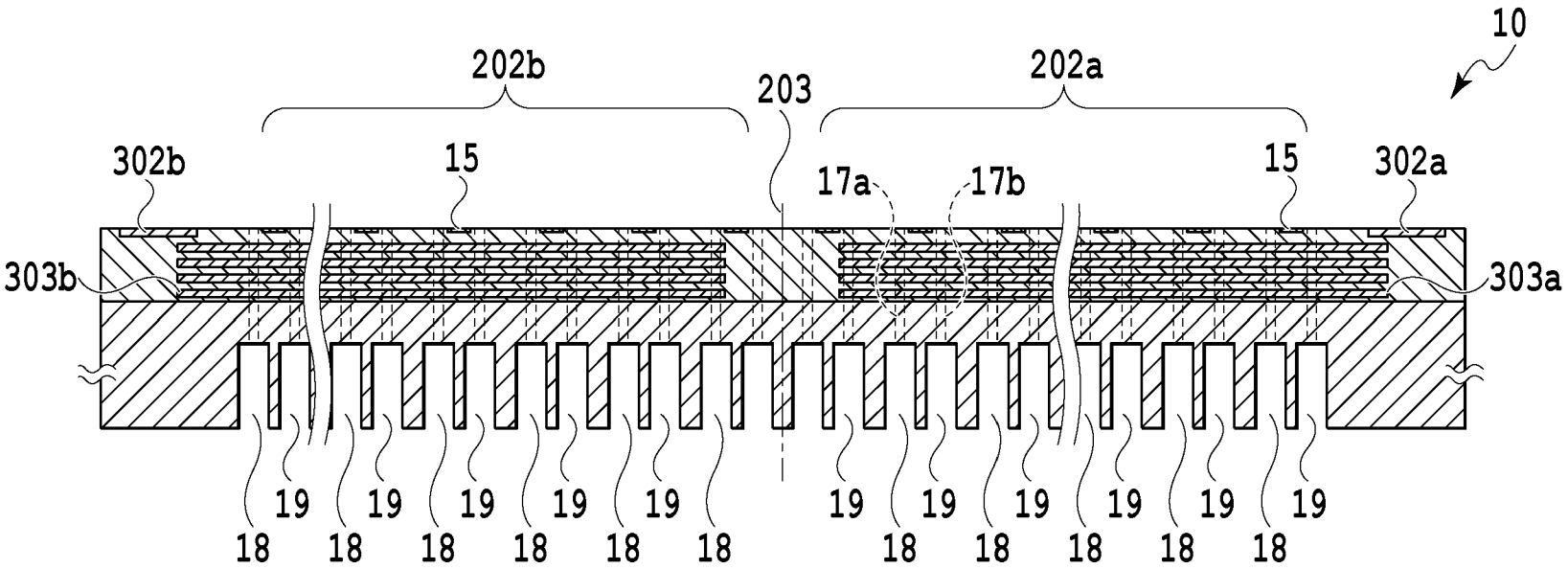
FIG. 12 is a cross-sectional view of the printing element substrate.

FIG. 12 is a cross-sectional view of the printing element substrate 10. In general, the printing element substrate 10 is obtained by forming energy generating elements 15 and wirings for supplying power thereto on a substrate 301 having ink supply ports, and further placing thereon a nozzle member having pressure chambers 23, ejection ports 13, partitions 22 and the like. FIG. 12 shows a state before the nozzle member is placed for the sake of explanation.

The wiring structure including the energy generating elements 15 (heaters), wirings 303 for supplying power thereto, pads 302 and the like is patterned on the substrate 301 having the supply ports 17*a* and collection ports 17*b* shown in FIG. 10, so as to avoid interference between each other. The structure of these ink flow paths and electrical wirings is formed symmetric about the center line 203. The electrical wirings are separated into the right and left areas as shown in FIG. 12. Power and an ejection signal are supplied to 10 nozzle arrays 14 on the right via a pad 302*a* and wirings 303*a* on the right and supplied to 10 nozzle arrays 14 on the left via a pad 302*b* and wirings 303*b* on the left. In short, power and an ejection signal are supplied to each energy generating element 15 via one of the pads 302*a* and 302*b* closer to the energy generating element 15.

Figure 13:
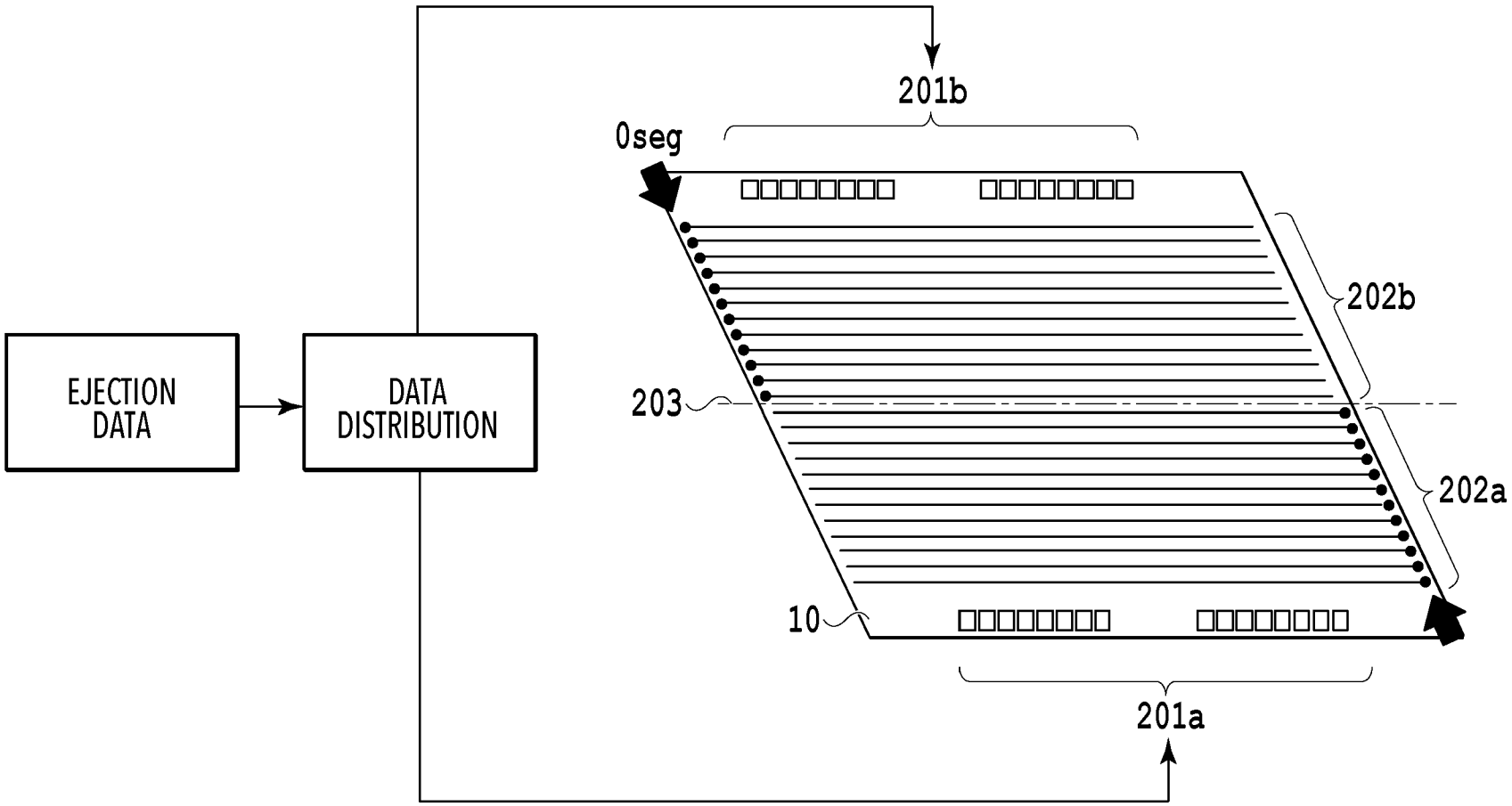
FIG. 13 is a diagram showing a state of distribution of ejection data to the printing element substrate.

FIG. 13 is a diagram showing a state of distribution of ejection data to one printing element substrate 10. Ejection data is distributed to the right and left areas and supplied to each energy generating element 15 via the pad 302*a* or 302*b* and the wiring 303*a* or 303*b*. At this time, since the printing element substrate 10 having the shape of a parallelogram has a rotationally symmetric structure also in terms of electricity, the ejection data is distributed such that a segment arrangement of ejection data input to a pad array 201*a* on one side is the inverse of a segment arrangement of ejection data input to a pad array 201*b* on the other side.

Figure 14A:
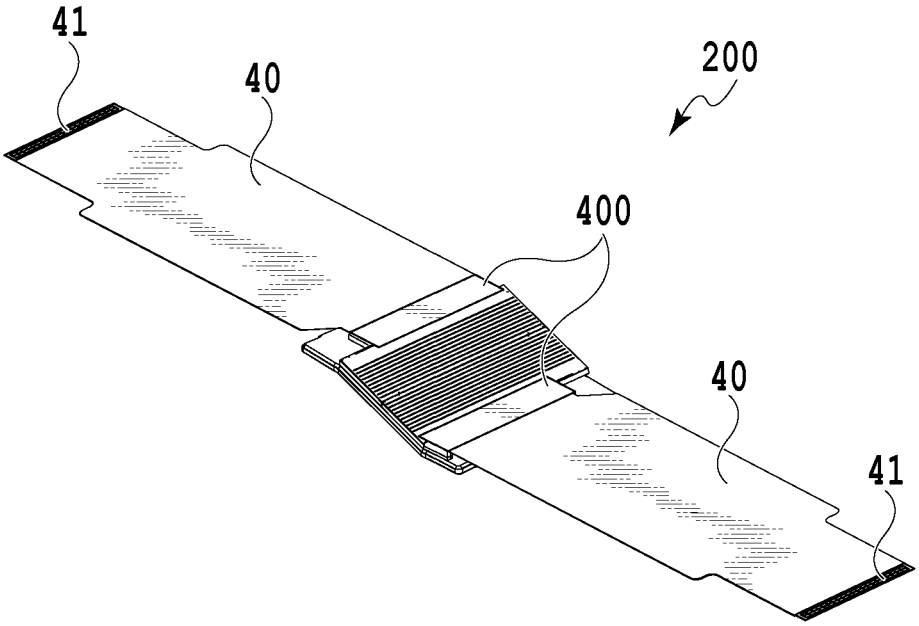
FIGS. 14A and 14B are diagrams showing a detailed configuration of an ejection module.
Figure 14B:
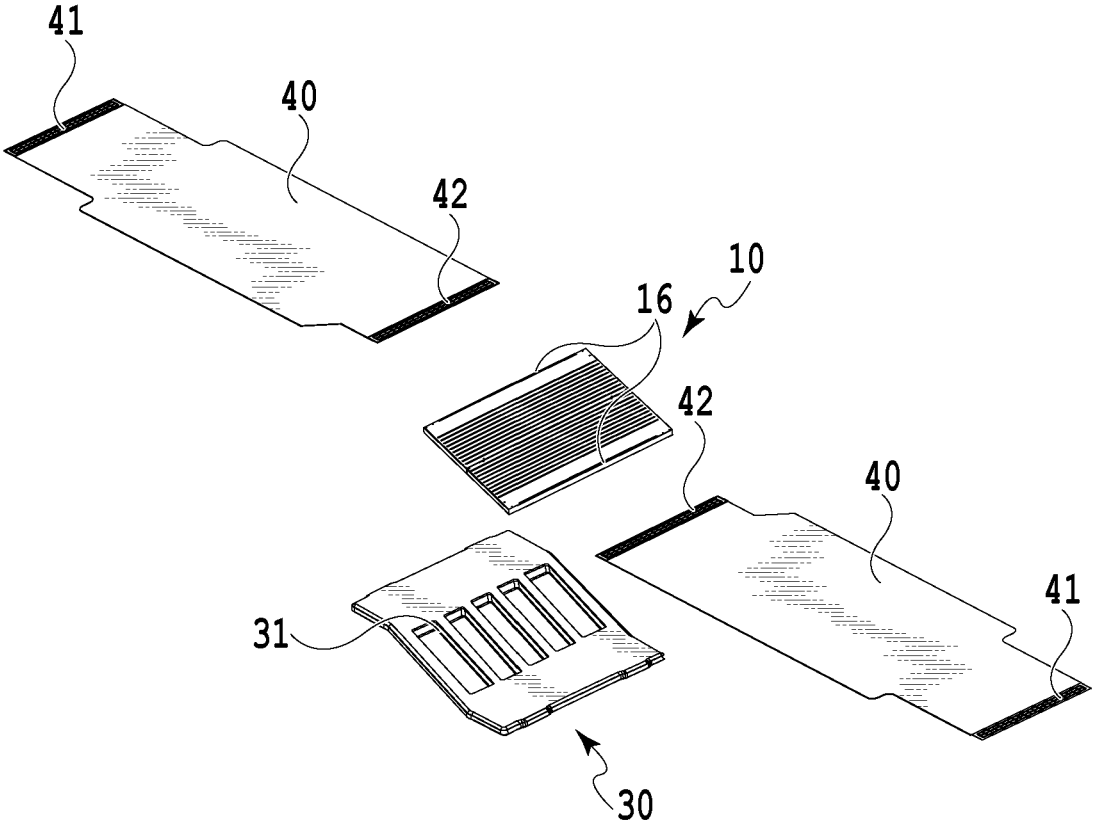

FIGS. 14A and 14B are diagrams showing a detailed configuration of one ejection module 200. FIG. 14A is a perspective view and FIG. 14B is an exploded view. As shown in FIG. 14B, the ejection module 200 is obtained by bonding a printing element substrate 10 onto a support member 30 and using wire bonding to connect terminals 16 on both sides of the printing element substrate 10 to terminals 42 of flexible circuits 40. Since electrical resistance in wire bonding is smaller than that in the case of connector connection, a voltage drop can be minimized. Wire bonding is therefore effective for an elongated inkjet printing head that performs high-speed driving like the present embodiment. The wire-bonded portions are further electrically sealed by applying a sealant 400. The support member 30 has liquid supply ports 31 to connect the back surface of the printing element substrate 10 fluidly to the first flow path member 50.

In each of the two flexible circuits 40, a terminal 41 (second terminal) on the opposite side of the printing element substrate 10 is electrically connected to a connection terminal 93 (first terminal) of the electrical substrate 90. The support member 30 has the liquid supply ports 31 to be connected to the individual flow paths 51 of the first flow path member 50. The support member 30 serves as a support of the printing element substrate 10 as well as a flow path member located between the printing element substrate 10 and the first flow path member 50. Accordingly, it is preferable that the support member 30 has a high degree of flatness and can be connected to the printing element substrate 10 with sufficiently high reliability. For example, alumina and a resin material are suitable for the support member 30.

Figure 15A:
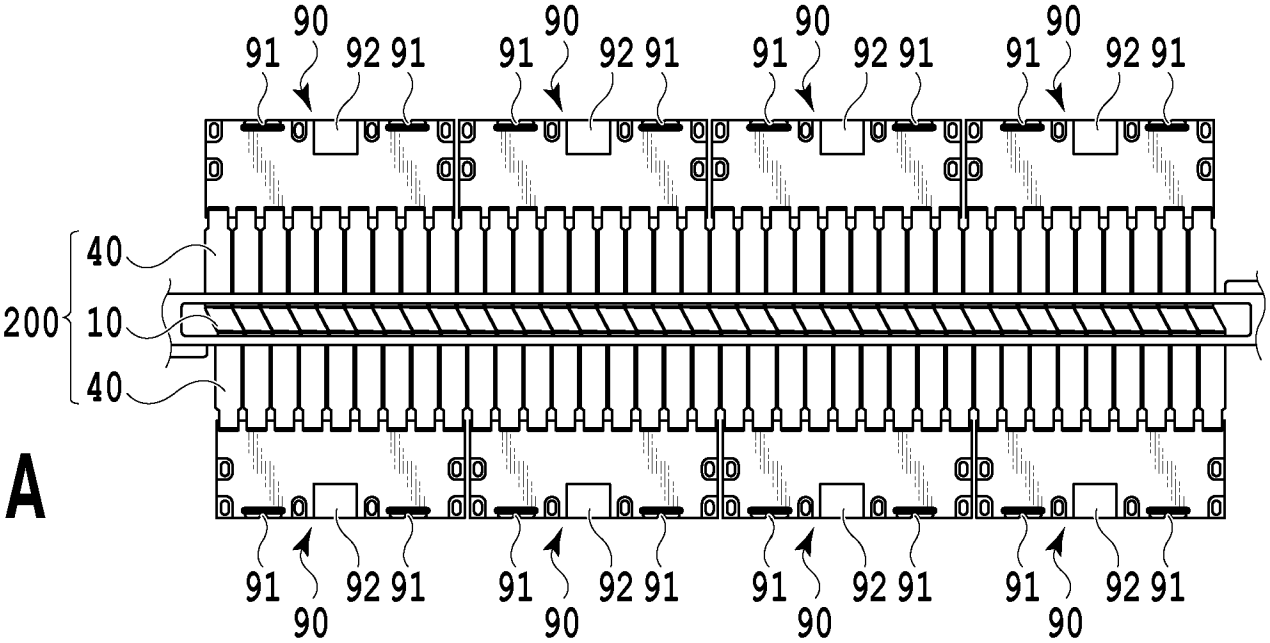
FIGS. 15A and 15B are diagrams showing a state of connection between ejection modules and electrical substrates.
Figure 15B:
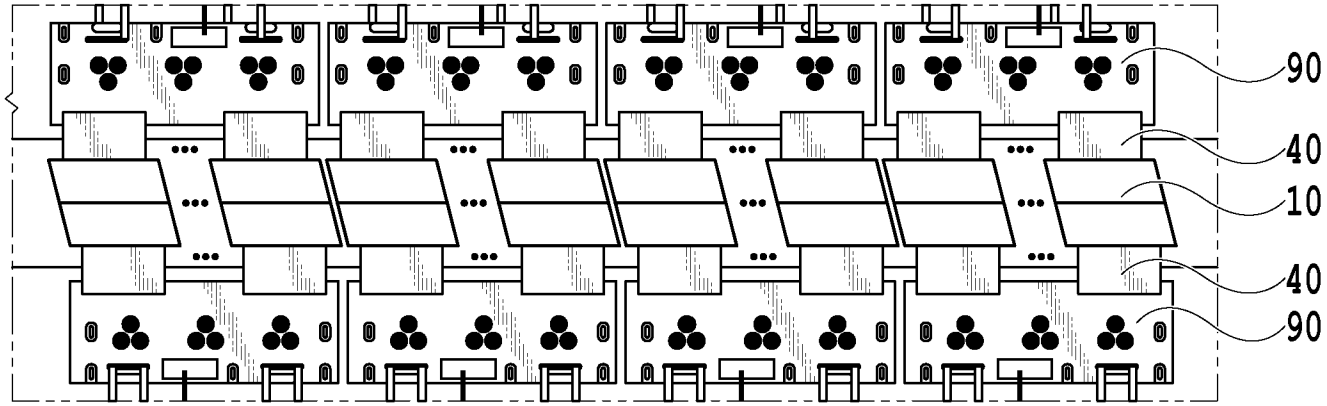
Figure 17:
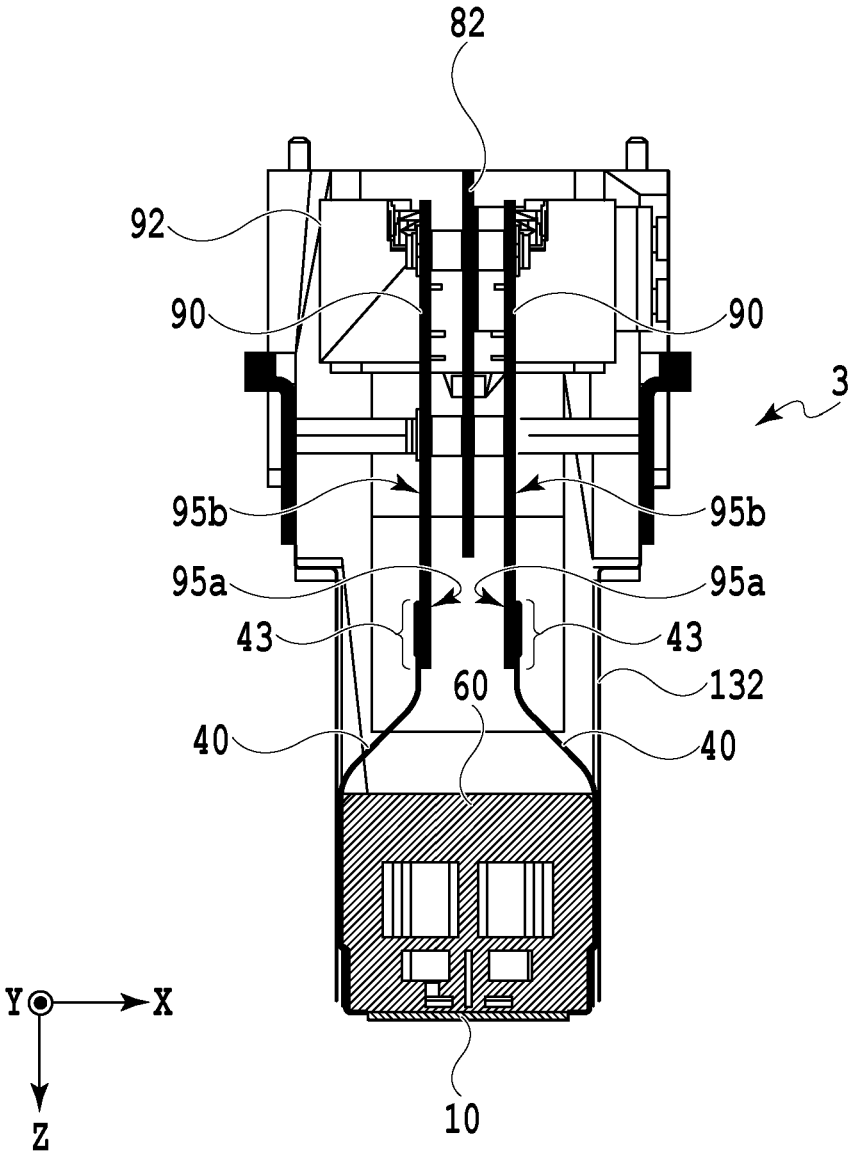
FIG. 17 is a cross-sectional view of the liquid ejection head.

FIGS. 15A and 15B are diagrams showing that 36 ejection modules 200 shown in FIG. 14A are arranged in parallel and each flexible circuit 40 is connected to an electrical substrate 90. After the ejection modules 200 are connected to the electrical substrates 90 via the flexible circuits 40, the flexible circuits 40 are bent as shown in FIG. 17 to be described later. FIGS. 15A and 15B show a state after the ejection modules 200 are electrically connected to the electrical substrates 90 and before the flexible circuits 40 are bent. As shown in FIG. 15A, in the present embodiment, four electrical substrates 90 each connected to nine flexible circuits 40 are arranged in parallel on each side of the printing element substrates 10 in the array direction. Before the flexible circuits 40 are bent, one printing element substrate 10 is connected to electrical substrates 90 located on both sides in a direction intersecting the array direction (Y direction) and each of the electrical substrates 90 supplies power and an ejection signal to the printing element substrate 10. In the case of connecting a plurality of the flexible circuits 40 to one electrical substrate 90 like the present embodiment, it is preferable that wirings for power supply to the plurality of the printing element substrates 10 are gathered on the electrical substrate 90. This can decrease the number of power supply terminals 92 and reduce the cost of the liquid ejection head.

Further, as shown in FIG. 3B and FIG. 15A, electrical connection terminals (third terminals) for the electrical connection to the body of the printing apparatus such as power supply terminals 92 are provided so as to be removed in the −Z direction (the opposite direction of the liquid ejection direction). That is, the electrical connection terminals of the electrical substrate 90 are provided at the end of the electrical substrate 90 in the −Z direction. In addition, in the present embodiment, connectors of the power supply terminals 92 as electrical connection terminals are opened in the −Z direction. The terminals on the body of the printing apparatus move in the Z direction toward the power supply terminals 92, thereby electrically connecting the terminals. As a result, distances between the printing element substrates 10 connected to the electrical substrate 90 and the electrical connection terminals connected to them can be equal and the electrical properties can easily be made uniform. Further, in a case where the electrical substrates 90 are arranged in the Y direction, the configuration can be simplified without interference of wirings connected to the electrical connection terminals with adjacent electrical substrates 90. Furthermore, in the printing apparatus 1000 in which liquid ejection heads 3 are arranged in the X direction as shown in FIG. 1, interference between liquid ejection heads 3 adjacent to each other in the X direction can be avoided.

FIG. 15B shows an electrical circuit layout in the case of connecting ejection modules 200 to electrical substrates 90 as shown in FIG. 15A. Printing element substrates 10 having the shape of a parallelogram are arrayed in a line, electrical substrates 90 are symmetrically arranged on both sides of the printing element substrates 10, and the entire electrical circuit has a point symmetric (rotationally symmetric) structure.

At this time, since each printing element substrate 10 has the shape of a parallelogram, opposing terminals 16 are shifted from each other in the Y direction as shown in FIG. 9A. Accordingly, flexible circuits 40 connected to the terminals 16 are also shifted from each other in the Y direction and electrical substrates 90 on one surface of the electrical substrate support 82 are shifted from those on the other surface in the Y direction as shown in FIG. 5B. However, signal input terminals 91 and power supply terminals 92 provided in electrical substrates 90 are located in the same positions in the Y direction as shown in FIG. 5B when the electrical substrates 90 are attached to the electrical substrate support 82. In other words, the electrical substrates 90 of the present embodiment are designed such that the signal input terminals 91 and the power supply terminals 92 are located in the same positions in the Y direction regardless of whether the electrical substrates 90 are located on the +X side or X side of the electrical substrate support 82. Consequently, FPCs and FFCs (not shown) provided on both sides of the electrical substrate support 82 and connected between substrates in the body of the printing apparatus and the signal input terminals 91 or power supply terminals 92 can be arranged in parallel and symmetrically, thereby simplifying the configuration of wirings in the apparatus.

In the present embodiment, since the number (36) of arrayed printing element substrates 10 is a multiple of the number (4) of electrical substrates arrayed on one side of the printing element substrates 10, all the eight electrical substrates 90 each connected to the same number (9) of flexible circuits 40 can have an identical shape. Further, all the printing element substrates 10 and all the flexible circuits 40 forming the ejection modules 200 are also identical in shape. Accordingly, an elongated liquid ejection head 3 can be manufactured by producing a number of printing element substrates 10, flexible circuits 40, and electrical substrates 90, conducting electrical inspection individually, performing electrical inspection for products individually, and combining only qualified products as shown in FIG. 15A. As a result, manufacturing yields of the liquid ejection head 3 can be improved and manufacturing cost can be reduced as compared with the case of manufacturing an elongated electrical printed circuit board and an elongated printing element substrate. In other words, a liquid ejection head can be further elongated without largely raising manufacturing cost.

Figure 16A:
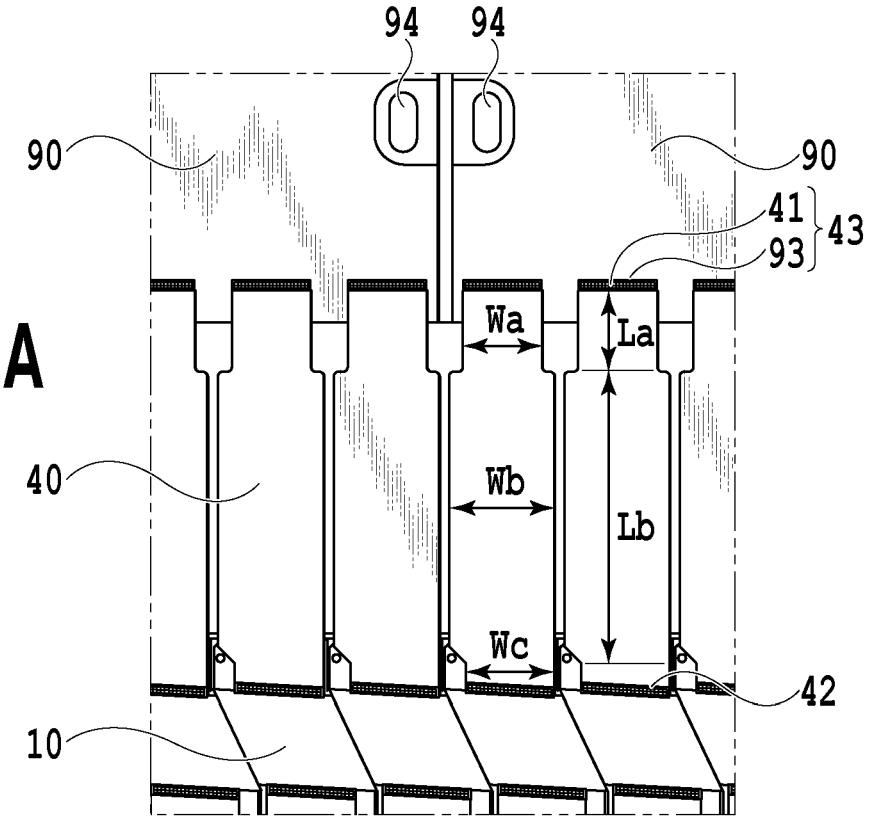
FIGS. 16A and 16B are enlarged views of flexible circuits.
Figure 16B:
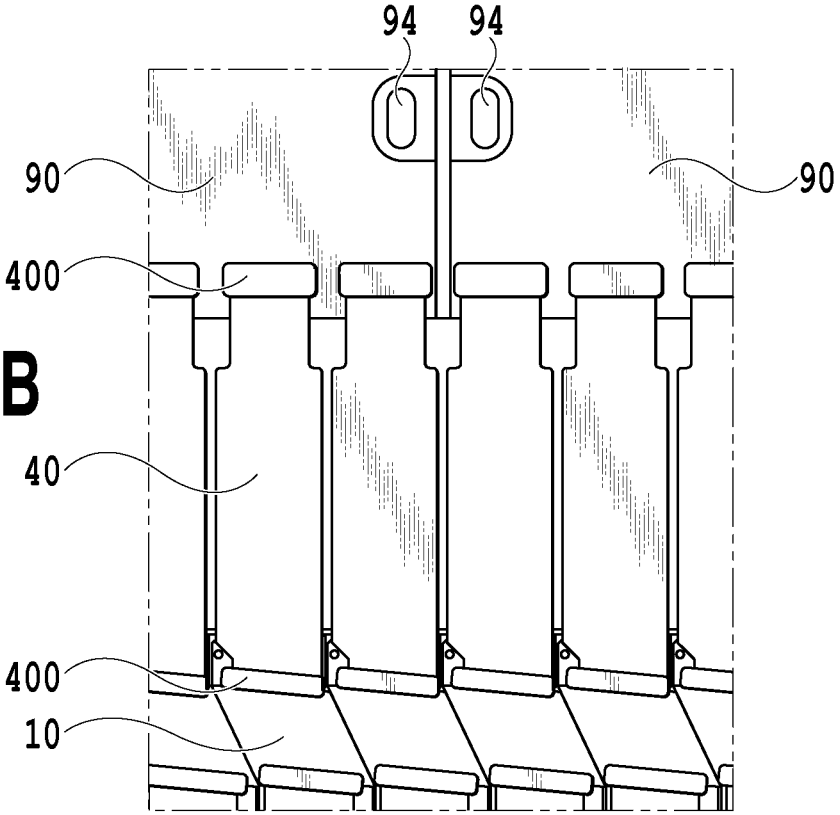

FIGS. 16A and 16B are enlarged views of flexible circuits 40 connecting printing element substrates 10 to electrical substrates 90. FIG. 16A shows a state before a sealant is applied to connection portions and FIG. 16B shows a state after it is applied. FIGS. 16A and 16B show a state after the ejection modules 200 are electrically connected to the electrical substrates 90 and before the flexible circuits 40 are bent.

In the present embodiment, each flexible circuit 40 does not have a uniform width in the Y direction. More specifically, a width Wa near a terminal 41 connected to an electrical substrate 90 is smaller than a width Wb of a central area. Further, a width We near a terminal 42 connected to a printing element substrate 10 is larger than the width Wa near the terminal 41 and smaller than the width Wb of the central area. In short, Wa<We<Wb. A length La of the area near the terminal 41 and having the width Wa is smaller than a length Lb of the central area having the width Wb. That is, La<Lb.

An area for connection where no wiring can be laid out must be provided between two adjacent electrical substrates 90. Further, although the sealant 400 is applied to each of the terminals 41 and 42 after wire bonding, the terminals 42 should preferably be arranged at sufficient intervals d to avoid interference therebetween. Consequently, the width of the electrical substrate 90 is designed to exceed the total width of the terminals 41 of the nine flexible circuits 40, the nine flexible circuits 40 being arranged at the intervals d and connected to the electrical substrate 90.

On the other hand, in the flexible circuits 40 which connect the electrical substrates 90 to the printing element substrates 10 and through which a current flows for high-speed driving of 10 printing element arrays, it is necessary to minimize a voltage drop in paths, that is, to minimize electrical resistance. In particular, when two flow paths, the liquid supply path 18 and the liquid collection path 19, are provided for each nozzle array 14 like the ink circulation type liquid ejection head of the present embodiment, a width in the X direction is large as shown in FIG. 9B, which causes a voltage drop. In consideration of the above situation, in the flexible circuit 40 of the present embodiment, the width Wb in a direction orthogonal to the direction of current flow is enlarged as much as possible and the length Lb of such an area is enlarged as much as possible in the length direction.

Incidentally, wirings inside the flexible circuit 40 should preferably have a multilayer structure. This is because the multilayer structure can gather wirings for power supply, substantially increase the cross-sectional area of wirings, and substantially reduce electrical resistance. It is also effective in reducing a voltage drop to provide a capacitor in wirings for power supply. The capacitor can lessen a sharp voltage drop even if ejection frequency increases and a large current momentarily flows.

FIG. 17 is a cross-sectional view of the liquid ejection head 3 shown in FIGS. 3A and 3B. FIG. 17 shows the flexible circuits 40 (not shown in FIGS. 3A and 3B) which connect the printing element substrate 10 to the electrical substrates 90.

The liquid ejection head 3 has a symmetric structure with respect to the electrical substrate support 82. The electrical substrate support 82 is located in the center immediately above the printing element substrate 10 so as to be orthogonal to the plane of the printing element substrate 10. The electrical substrate support 82 supports the electrical substrates 90 in parallel on both sides. In the X direction, the electrical substrate support 82 and the electrical substrates 90 are located within the second flow path member 60 which ensures the stiffness of the entire liquid ejection head 3 as a whole.

The two flexible circuits 40 connected to the respective sides of the printing element substrate 10 are provided along the outer perimeter of the second flow path member 60 and connected to the respective electrical substrates 90. To be more specific, each flexible circuit 40 is bent 90° from the lower surface of the second flow path member 60 along the corner, extended upward along the side wall of the second flow path member 60, bent again toward the upper surface along the corner, further bent in a direction away from the second flow path member 60, and then connected to the electrical substrate 90. All of these members are protected by the shields 132.

In the completed liquid ejection head 3 in which the flexible circuits 40 are bent as shown in FIG. 17, the electrical substrates 90 are arrayed in the array direction (Y direction) of the printing element substrates 10. The arrays (two arrays in the present embodiment) of the electrical substrates 90 (electrical substrate arrays) are provided such that at least parts of surfaces 95*a* of the electrical substrates 90 are opposed to each other.

Further, as shown in FIG. 17, an electrical connection portion 43 between the terminal 41 of the flexible circuit 40 and the terminal 93 of the electrical substrate 90 is provided on a back surface 95*b* (second surface) of a surface 95*a* (first surface) of the electrical substrate 90 opposed to an electrical substrate 90 in the other array. This configuration is preferable in the following respects: first, the electrical substrates 90 can be manufactured at low cost if the electrical connection portions 43 with flexible circuits 40 and the electrical connection terminals (such as signal input terminals 91 and power supply terminals 92) are formed on the same surface; second, if the electrical connection terminals are provided on the back surface 95*b* of the surface 95*a* of the electrical substrate 90 opposed to an electrical substrate 90 in the other array, the terminals can be connected without interference with the opposing electrical substrate 90, thereby improving workability. Accordingly, the workability can be improved by providing the electrical connection portion 43 between the flexible circuit 40 and the electrical substrate 90 on the back surface 95*b* of the surface 95*a* of the electrical substrate 90 opposed to an electrical substrate 90 in the other array.

In the layout described above, even if electrical components mounted on the electrical substrates 90 somewhat protrude, the protruding components can be prevented from protruding from the width area (X direction area) of the second flow path member 60 as much as possible, thereby reducing the width of the entire liquid ejection head 3 to the width of the printing element substrate 10. At this time, the electrical substrate support 82 should not necessarily be orthogonal to the plane of the printing element substrate 10 immediately above the plane. The advantageous result of reducing the width of the liquid ejection head 3 can be produced as long as the electrical substrates 90 are arrayed in lines (two lines in the present embodiment) along a plane included in an area in a normal direction of a plane on which the printing element substrates 10 are arrayed.

In the above description, FIG. 16A is used to explain the case where Wa<We<Wb, where Wa is the width near the terminal 41, Wb is the width of the central area, and We is the width near the terminal 42. However, the present invention is not limited to this case. The advantageous result of the present invention can be achieved provided that Wa<Wb, where Wa is the width near the terminal 41 and Wb is the width of the other areas.

Further, as shown in FIGS. 16A and 16B, holes 94 formed in the electrical substrates 90 to attach the electrical substrates 90 to the electrical substrate support 82 should preferably be elongated in the Z direction. It is difficult to locate the electrical substrates 90 in predetermined positions in the case of connecting the electrical substrates 90 to the printing element substrates 10 via the flexible circuits 40 while the electrical substrates 90 and the printing element substrates 10 are on the same plane as shown in FIGS. 15A and 15B and then binding the flexible circuits 40 such that the electrical substrates 90 are orthogonal to the plane of the printing element substrates 10 as shown in FIG. 17, for example. That is, it is difficult to bend the flexible circuits 40 in particular positions. The electrical substrates 90 are located in positions in the Z direction following the bent state of the flexible circuits 40. Here, if holes for attaching the electrical substrates 90 to screw holes provided in the electrical substrate support 82 are circular holes, the electrical substrates 90 are located in the positions of the screw holes, not the positions following the bent state of the flexible circuits 40. Accordingly, stress is imposed on the flexible circuits 40, which may result in breakage. In contrast, if the attachment holes 94 of the electrical substrates 90 are elongated in the Z direction, it is possible to locate the electrical substrates 90 in the positions following the bent state of the flexible circuits 40 and reduce breakage in the flexible circuits 40.

It should be noted that if the width We near the terminal 42 is smaller than the width Wb, interference between adjacent printing element substrates 10 during and after assembly can be reduced in the same manner as the electrical substrates 90. In addition to this, the printing element substrates require smaller areas for connection than those required for the electrical substrates. In view of the above, it is preferable that Wa<We<Wb in order to minimize electrical resistance while ensuring requisite minimum connection areas.

As described above, in each of the flexible circuits 40 of the ejection modules 200 of the present embodiment, the width Wa near the terminal connected to the electrical substrate 90 is smaller than the widths of the other areas. This makes it possible to reduce a voltage drop and manufacture an elongated printing head capable of high-speed printing at low cost.

Other Embodiments

In the embodiment described above, the printing element substrates 10 having the shape of a parallelogram are arrayed in a line in the Y direction, one electrical substrate 90 is provided on each side of nine printing element substrates 10, and one printing element substrate 10 is connected to two flexible circuits 40. However, the present invention is not limited to this configuration.

Figure 18A:
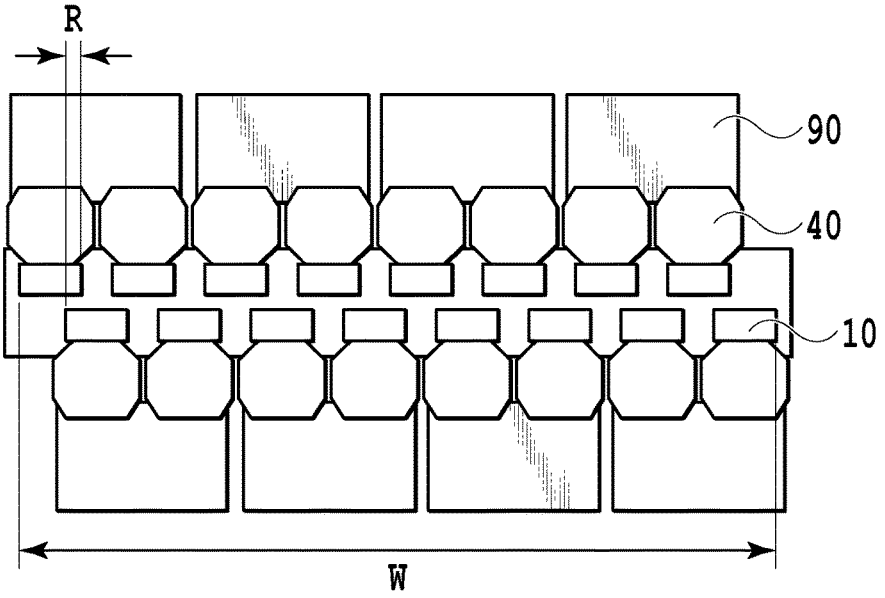
FIGS. 18A to 18C are diagrams showing other embodiments of a state of connection between various substrates.
Figure 18B:
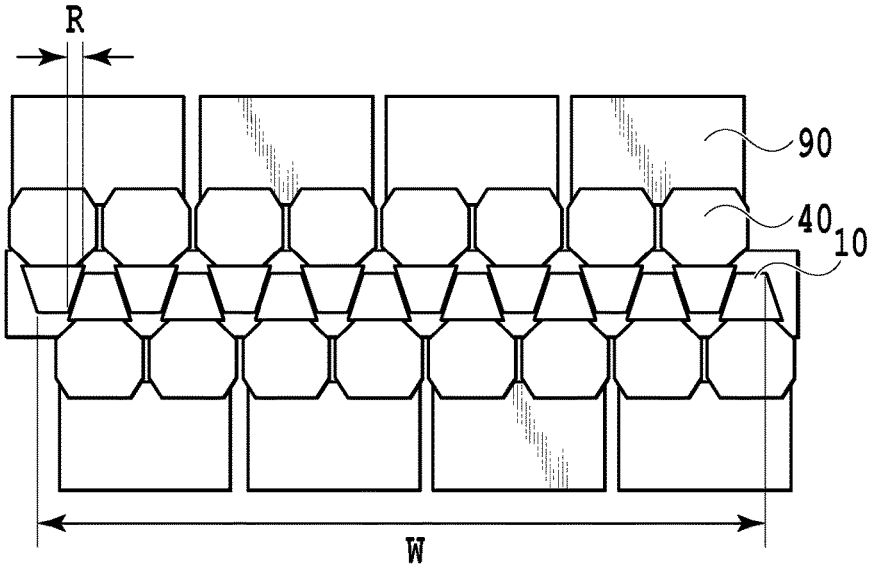
Figure 18C:
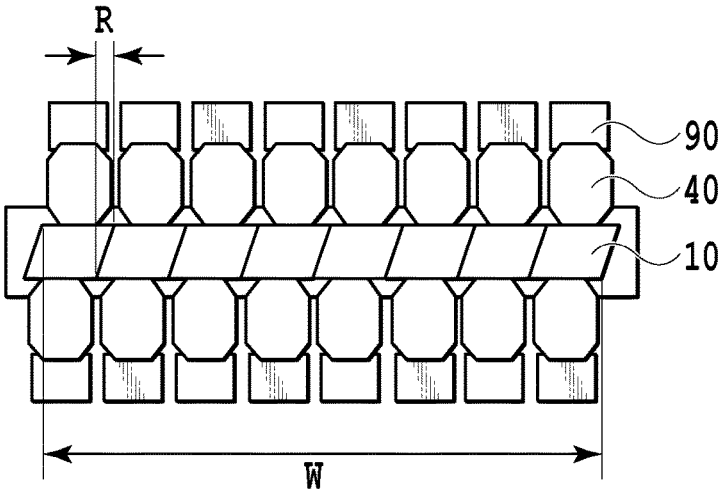

FIGS. 18A to 18C are diagrams showing other embodiments of a state of connection between printing element substrates 10, flexible circuits 40, and electrical substrates 90, which can be used in the present invention. FIGS. 18A to 18C show a state after the printing element substrates 10 included in the ejection modules 200 are electrically connected to the electrical substrates 90 and before the flexible circuits 40 are bent. FIG. 18A shows a case where rectangular printing element substrates 10 are laid out continuously in the Y direction while being staggered in the X direction. FIG. 18B shows a case where trapezoidal printing element substrates 10 are laid out continuously in the Y direction while alternately changing their orientation. In either configuration, the printing element substrates 10 are arrayed in the Y direction with overlapping areas R and a printing area of a width W is ensured. Further, each printing element substrate 10 is connected to only one flexible circuit 40 and two flexible circuits 40 arranged in the Y direction are connected to one electrical substrate 90.

In contrast, FIG. 18C shows a case where two flexible circuits 40 are connected to respective sides of a printing element substrate 10 having the shape of a parallelogram like the embodiment described above. In this configuration, however, one electrical substrate 90 is connected to one flexible circuit 40.

In any of the configurations described above, a voltage drop from the electrical substrates 90 to the printing element substrates 10 can be suppressed by using the flexible circuits 40 each having a central area of a width Wb larger than a width Wa near the terminal 41 connected to the electrical substrate 90 like the embodiment described above. As a consequence, an elongated printing head capable of high-speed printing can be manufactured at low cost.

In the above embodiments, the liquid ejection head using a heater as the energy generating element 15 has been described. However, the energy generating element 15 of the present invention is not limited to this. For example, a piezoelectric element having a volume expanded by applying a voltage or the like can be used as an energy generating element.

Further, liquid ejected from the liquid ejection head 3 should not necessarily be circulated in the configuration shown in FIG. 2. For example, ink may be circulated through pressure chambers by providing two tanks upstream and downstream of the liquid ejection head 3 and passing ink from one tank to the other tank. Further, the liquid ejection head may have only a supply path without a collection path.

In any case, the advantageous result of the present invention can be achieved as long as liquid ejection modules are arranged in parallel in a liquid ejection head and each of printing element substrates are connected to electrical substrates via flexible circuits. That is, a liquid ejection head capable of high-speed printing can be realized by suppressing a voltage drop by adjusting the widths of a flexible circuit such that a width near a terminal connected to an electrical substrate is smaller than the widths of the other areas.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-084681, filed Apr. 21, 2017, and No. 2018-037486, filed Mar. 2, 2018, which are hereby incorporated by reference herein in their entirety.

What is claimed is:

1. A liquid ejection head comprising:

a plurality of element substrates on which elements configured to eject liquid are arrayed;

a plurality of electrical substrates each equipped with a first terminal and configured to supply power and an ejection signal to the element substrates;

a plurality of flexible circuits each equipped with a second terminal electrically connected to the first terminal and configured to connect each of the element substrates to the corresponding electrical substrate electrically; and a flow path member including a lower surface on which the element substrates are arrayed and configured to supply liquid to the element substrates, wherein the plurality of electrical substrates form a plurality of electrical substrate arrays along planes different from a plane on which the plurality of element substrates are arrayed, and extending in a direction in which the element substrates are arrayed, each of the flexible circuits electrically connects the element substrate to the corresponding electrical substrate while being bent, the plurality of electrical substrate arrays include two electrical substrate arrays arranged such that at least parts of first surfaces of the electrical substrates are opposed to each other, and when viewed from a direction orthogonal to the lower surface of the flow path member, the plurality of electrical substrates are provided within an area of the lower surface of the flow path member.

2. The liquid ejection head according to claim 1, wherein the two electrical substrate arrays are along planes including areas in a normal direction of the plane on which the plurality of element substrates are arrayed.

3. The liquid ejection head according to claim 1, wherein the two electrical substrate arrays are along planes orthogonal to the plane on which the plurality of element substrates are arrayed.

4. The liquid ejection head according to claim 1, wherein each of the flexible circuits is bent 90° from the lower surface of the flow path member along a corner, extended along a side wall, bent again toward an upper surface along a corner, further bent in a direction away from the flow path member, and then connected to the corresponding electrical substrate in one of the two electrical substrate arrays.

5. The liquid ejection head according to claim 1, wherein the plurality of element substrates are arrayed while overlapping each other such that the elements are continuously arrayed in a direction in which the element substrates are arrayed, and each of the plurality of element substrates is connected to the flexible circuits on both sides in a direction intersecting the direction in which the element substrates are arrayed, the flexible circuits being electrically connected to the electrical substrates in one of the two electrical substrate arrays.

6. The liquid ejection head according to claim 1, wherein each of the plurality of electrical substrates is electrically connected to the same number of the element substrates via the flexible circuits, the same number being more than one.

7. The liquid ejection head according to claim 1, wherein the plurality of electrical substrates have an identical structure, and a structure in which the plurality of element substrates, the plurality of electrical substrates, and the plurality of flexible circuits are arrayed is rotationally symmetric.

8. The liquid ejection head according to claim 1, wherein in each of the flexible circuits, a width on a side connected to the corresponding electrical substrate is shorter than the width of another area of the flexible circuit.

9. The liquid ejection head according to claim 1, wherein the flexible circuits are electrically connected to the element substrates and the electrical substrates by wire bonding, and a sealant is applied to areas of the electrical connection.

10. The liquid ejection head according to claim 1, wherein wirings in the flexible circuits have a multilayer structure.

11. The liquid ejection head according to claim 1, wherein wirings for power supply in the flexible circuits include a capacitor.

12. The liquid ejection head according to claim 1, wherein each of the element substrates is equipped with an energy generating element for generating energy for ejecting liquid and a pressure chamber including the energy generating element therein and storing liquid for ejecting, and the liquid is circulated between the inside and outside of the pressure chamber.

13. The liquid ejection head according to claim 1, wherein each of the electrical substrates is equipped with a third terminal on a second surface, which is a back surface of the first surface, the third terminal being electrically connected to an inkjet printing apparatus body on which the liquid ejection head is mounted.

14. The liquid ejection head according to claim wherein each of the electrical substrates is equipped with a third terminal at an end of a second surface, which is a back surface of the first surface, in an opposite direction of a liquid ejection direction, the third terminal being electrically connected to an inkjet printing apparatus body on which the liquid ejection head is mounted.

15. The liquid ejection head according to claim 14, wherein the third terminal is arranged such that a terminal of the inkjet printing apparatus body is offset in the liquid ejection direction and is thereby electrically connected to the third terminal.

16. The liquid ejection head according to claim 1, wherein electrical connection portions between the first terminals and the second terminals are provided on second surfaces which are back surfaces of the first surfaces of the electrical substrates.

17. A liquid ejection head comprising:

a plurality of element substrates on which elements configured to eject liquid are arrayed;

a plurality of electrical substrates each equipped with a first terminal and configured to supply power and an ejection signal to the element substrates;

a plurality of flexible circuits each equipped with a second terminal electrically connected to the first terminal and configured to connect the element substrate to the corresponding electrical substrate electrically; and a support plate supporting the plurality of electrical substrates, wherein the plurality of electrical substrates form a plurality of electrical substrate arrays along planes different from a plane on which the plurality of element substrates are arrayed, and extending in a direction in which the element substrates are arrayed, each of the flexible circuits electrically connects the element substrate to the corresponding electrical substrate while being bent, the plurality of electrical substrate arrays include two electrical substrate arrays arranged such that at least parts of first surfaces of the electrical substrates are opposed to each other, and the plurality of electrical substrates are provided on a first surface of the support plate and a second surface of the support plate, the second surface of the support plate being opposite to the first surface.

18. An inkjet printing apparatus configured to print an image on a print medium by ejecting ink based on an ejection signal by the use of an inkjet printing head, the inkjet printing head comprising:

a plurality of element substrates on which elements configured to eject ink are arrayed;

a plurality of electrical substrates each equipped with a first terminal and configured to supply power and an ejection signal to the plurality of element substrates;

a plurality of flexible circuits each equipped with a second terminal electrically connected to the first terminal and configured to connect each of the element substrates to the corresponding electrical substrate electrically; and a flow path member including a lower surface on which the element substrates are arrayed and configured to supply liquid to the element substrates, wherein the plurality of electrical substrates form electrical substrate arrays along planes different from a plane on which the plurality of element substrates are arrayed, and extending in a direction in which the plurality of element substrates are arrayed, each of the flexible circuits electrically connects the element substrate to the corresponding electrical substrate while being bent, the plurality of electrical substrate arrays include two electrical substrate arrays arranged such that at least parts of first surfaces of the electrical substrates are opposed to each other, and when viewed from a direction orthogonal to the lower surface of the flow path member, the plurality of electrical substrates are provided within an area of the lower surface of the flow path member.

19. The inkjet printing apparatus according to claim 18, wherein the two electrical substrate arrays are along planes orthogonal to the plane on which the plurality of element substrates are arrayed.

20. The inkjet printing apparatus according to claim 18, further comprising an inkjet printing apparatus body on which the ink jet print head is mounted, wherein each of the electrical substrates is equipped with a third terminal on a second surface which is a back surface of the first surface, the third terminal being electrically connected to the inkjet printing apparatus body.

* * * * *